US007806175B2

(12) United States Patent
Hickie

(10) Patent No.: US 7,806,175 B2
(45) Date of Patent: Oct. 5, 2010

(54) RETRIVEVABLE FRAC MANDREL AND WELL CONTROL STACK TO FACILITATE WELL COMPLETION, RE-COMPLETION OR WORKOVER AND METHOD OF USE

(75) Inventor: Barton E. Hickie, Oklahoma City, OK (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 362 days.

(21) Appl. No.: 11/803,030

(22) Filed: May 11, 2007

(65) Prior Publication Data

US 2008/0277120 A1 Nov. 13, 2008

(51) Int. Cl.
*E21B 19/00* (2006.01)
*E21B 33/04* (2006.01)

(52) U.S. Cl. ..... 166/75.13; 166/88.1; 166/86.1; 166/86.2

(58) Field of Classification Search ..... 166/308.1, 166/86.2, 85.1, 86.1, 88.1, 92.1, 301.01, 166/191, 316, 373; 277/530, 332, 338, 647
See application file for complete search history.

(56) References Cited

U.S. PATENT DOCUMENTS 3,391,735 A 7/1968 Schramm et al.
4,076,079 A 2/1978 Herricks et al.
5,012,865 A 5/1991 McLeod
5,103,900 A * 4/1992 McLeod et al. ..... 166/88.1
5,285,852 A 2/1994 McLeod
5,309,993 A * 5/1994 Coon et al. ..... 166/115
5,332,044 A 7/1994 Dallas et al.
5,372,202 A 12/1994 Dallas
5,785,121 A 7/1998 Dallas
5,819,851 A 10/1998 Dallas
5,975,211 A 11/1999 Harris
6,015,014 A 1/2000 Macleod et al.
6,039,120 A 3/2000 Wilkins et al.
6,220,363 B1 4/2001 Dallas
6,247,537 B1 6/2001 Dallas
6,289,993 B1 9/2001 Dallas
6,364,024 B1 4/2002 Dallas
6,557,629 B2 5/2003 Wong et al.
6,626,245 B1 9/2003 Dallas
6,817,421 B2 11/2004 Dallas
6,918,439 B2 7/2005 Dallas
6,918,441 B2 7/2005 Dallas
6,920,925 B2 7/2005 Duhn et al.
6,938,696 B2 9/2005 Dallas
7,055,632 B2 * 6/2006 Dallas ..... 175/382
7,159,663 B2 1/2007 McGuire et al.
7,207,384 B2 4/2007 Dallas et al.

(Continued)

*Primary Examiner*—Daniel P Stephenson
*Assistant Examiner*—Michael Willis, III
(74) *Attorney, Agent, or Firm*—Nelson Mullins Riley & Scarborough, LLP

(57) ABSTRACT

A retrievable frac mandrel and a well control adapter are used to efficiently accomplish well completion, re-completion or workover. The retrievable frac mandrel is inserted in a tubing head spool of a well to be completed, re-completed or re-worked. The well control adapter is mounted to a top of the tubing head spool and seals off against a top of the retrievable frac mandrel. After well completion, re-completion or workover is completed, the frac mandrel can be retrieved from the tubing head spool without killing or plugging the well.

10 Claims, 25 Drawing Sheets

U.S. PATENT DOCUMENTS

| | | | | |
|---|---|---|---|---|
| D546,665 | S | 7/2007 | Medlin | |
| 7,308,934 | B2 | 12/2007 | Swagerty et al. | |
| 7,322,407 | B2 | 1/2008 | Duhn et al. | |
| 2004/0154790 | A1 * | 8/2004 | Cornelssen et al. | 166/75.13 |
| 2005/0092496 | A1 | 5/2005 | Duhn et al. | |
| 2006/0060349 | A1 | 3/2006 | Duhn et al. | |
| 2006/0185841 | A1 | 8/2006 | Swagerty et al. | |
| 2008/0087439 | A1 * | 4/2008 | Dallas | 166/379 |
| 2008/0230226 | A1 * | 9/2008 | Lam et al. | 166/308.1 |

* cited by examiner

RETRIVEVABLE FRAC MANDREL AND WELL CONTROL STACK TO FACILITATE WELL COMPLETION, RE-COMPLETION OR WORKOVER AND METHOD OF USE

FIELD OF THE INVENTION

This invention relates in general to hydrocarbon well completion, re-completion or workover and, in particular, to a retrievable frac mandrel and a well control adapter, and a method of using the frac mandrel and the well control adapter to facilitate well completion, re-completion or workover.

BACKGROUND OF THE INVENTION

It is well understood that attempts to maintain viable hydrocarbon supplies have necessitated the exploitation of more marginal hydrocarbon production zones. It is also well known that exploiting marginal hydrocarbon production zones requires the use of sophisticated well drilling techniques, such as horizontal drilling and multi-stage well completions. It is further known that marginal production zones generally require stimulation in order to be viable producers of hydrocarbons. As understood by those skilled in the art, the stimulation of hydrocarbon production zones generally requires pumping high-pressure fluids into the zones. In order to accomplish this, pressure-sensitive wellhead equipment must be protected during the stimulation process.

Many wellhead isolation tools have been developed to protect sensitive wellhead equipment while high pressure stimulation fluids are pumped into subterranean formations. A high-pressure mandrel of the wellhead isolation tool, commonly referred to as a "frac mandrel" provides the pressure isolation through the wellhead. Some wellhead isolation tools also provide full-bore access to a casing of the well in order to permit downhole operations such as logging, perforating and plugging to be performed through the tools. However, prior art wellhead isolation tools have known disadvantages. For example, they are expensive to use due to labor costs associated with delivering and operating them; they cannot be removed from a live well; or they are known to "get stuck" in the wellhead making them difficult or impossible to remove without killing or plugging a casing of the well.

There therefore exists a need for a retrievable frac mandrel with a well control adapter that can be left on a wellhead throughout a well completion, re-completion or workover operation, and that can be removed from the wellhead without killing the well or plugging the casing.

SUMMARY OF THE INVENTION

It is therefore an object of the invention to provide a retrievable frac mandrel with a well control adapter that can be left on a wellhead throughout a well completion, re-completion or workover, and that can be removed from the wellhead without killing the well or plugging the casing.

The invention therefore provides a retrievable frac mandrel and well control adapter for facilitating completion, re-completion or workover of a cased well having a wellhead with a tubing head spool, comprising: a frac mandrel having a top end and a bottom end, the bottom end being contoured to be received in the tubing head spool and to provide a high-pressure fluid seal with a seal bore located above a bit guide of the tubing head spool; and a well control adapter that mounts to a top flange of the tubing head spool, the well control adapter including an axial seal bore that receives the top end of the frac mandrel to provide a high-pressure fluid seal around a periphery of the top end, and an axial passage that has a diameter smaller than an outer diameter of the top end of the frac mandrel but at least as large as an internal diameter of the frac mandrel.

The invention further provides a method of preparing for a completion, re-completion or workover of a cased well having a wellhead with a tubing head spool, comprising: inserting a bottom end of a frac mandrel into the tubing head spool and locking the frac mandrel in the tubing head spool; mounting a well control adapter to a top flange of the tubing head spool, the well control adapter having an axial seal bore that receives the top end of the frac mandrel to provide a high-pressure fluid seal around a periphery of the top end, and an axial passage that has a diameter smaller than an outer diameter of the top end of the frac mandrel but at least as large as an internal diameter of the frac mandrel.

The invention yet further provides a retrievable frac mandrel for facilitating well completion, re-completion or workover of a cased well equipped with a wellhead that includes a tubing head spool, comprising: a bottom end contoured to be received in the tubing head spool, the bottom end including a plurality of O-ring grooves with high pressure O-rings that seal off against a seal bore above a bit guide of the tubing head spool, and an annular groove engaged by lockdown screws of the tubing head spool to lock the frac mandrel in the tubing head spool; a top end that extends above a top of the tubing head spool; and, a central passage that extends from the top end to the bottom end, the central passage having an internal diameter at least as large as an internal diameter of a production casing of the cased well.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a retrievable frac mandrel and a well control adapter that are used for well completions, re-completions or workovers. The frac mandrel is received in a tubing head spool of a wellhead and locked in place using lockdown screws for securing a tubing hanger in the tubing head spool. A top of the frac mandrel projects above a top flange of the tubing head spool. The well control adapter has a central passage that receives a top of the frac mandrel and provides a high-pressure fluid seal around it. The frac mandrel and the well control adapter permit full-bore access to a casing of the well, and enable any downhole operation to be performed. After a well is completed, re-completed or re-worked, a central passage through the frac mandrel is sealed off, the well control adapter is removed and the frac mandrel is retrieved from the wellhead to permit the wellhead to be equipped for production.

Figure 1:
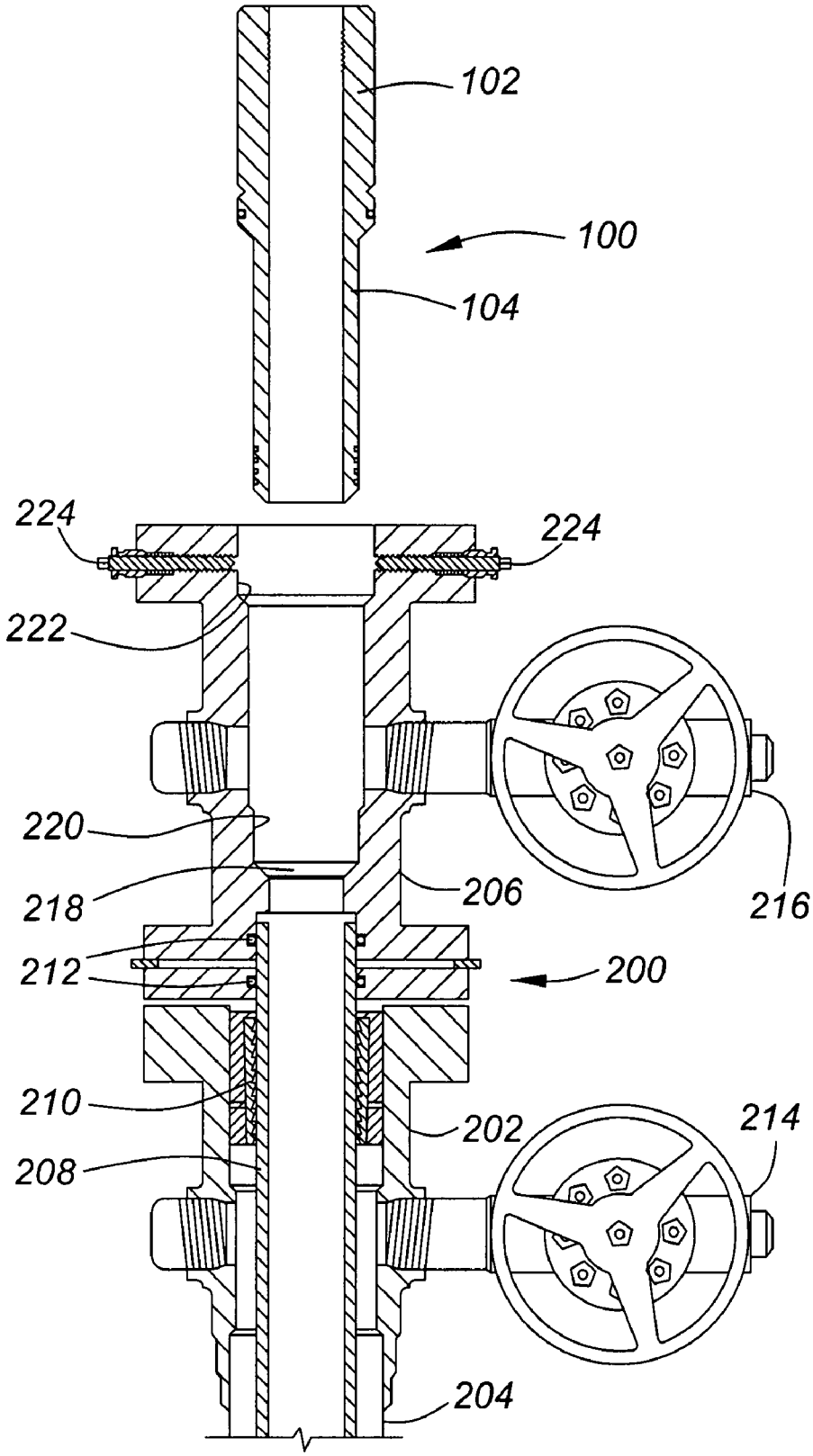
FIG. 1 is a schematic diagram of one embodiment of a retrievable frac mandrel in accordance with the invention suspended over a prior art wellhead.

FIG. 1 is a schematic cross-sectional diagram of a frac mandrel 100 in accordance with the invention suspended over a prior art wellhead 200. The frac mandrel 100 has a top end 102 and a bottom end 104. In this embodiment, the frac mandrel 100 is a single-piece frac mandrel.

The prior art wellhead 200 includes a tubing head spool 206 and a flanged surface casing spool 202 connected to a surface casing 204. A production casing 208 is supported by casing slips 210. A top end of the production casing 208 is sealed by high-pressure seals 212 that have been up-graded to 10,000 psi. A side valve 214 controls fluid flow from an annulus of the surface casing 204. A side valve 216 controls fluid flow from the production casing 208. A bit guide 218 terminates a seal bore 220 in a bottom of the tubing head spool. A tubing bowl seal bore 222 is located beneath lock down screws 224 that are used to lock a tubing hanger in the tubing bowl of the tubing head spool.

Figure 2:
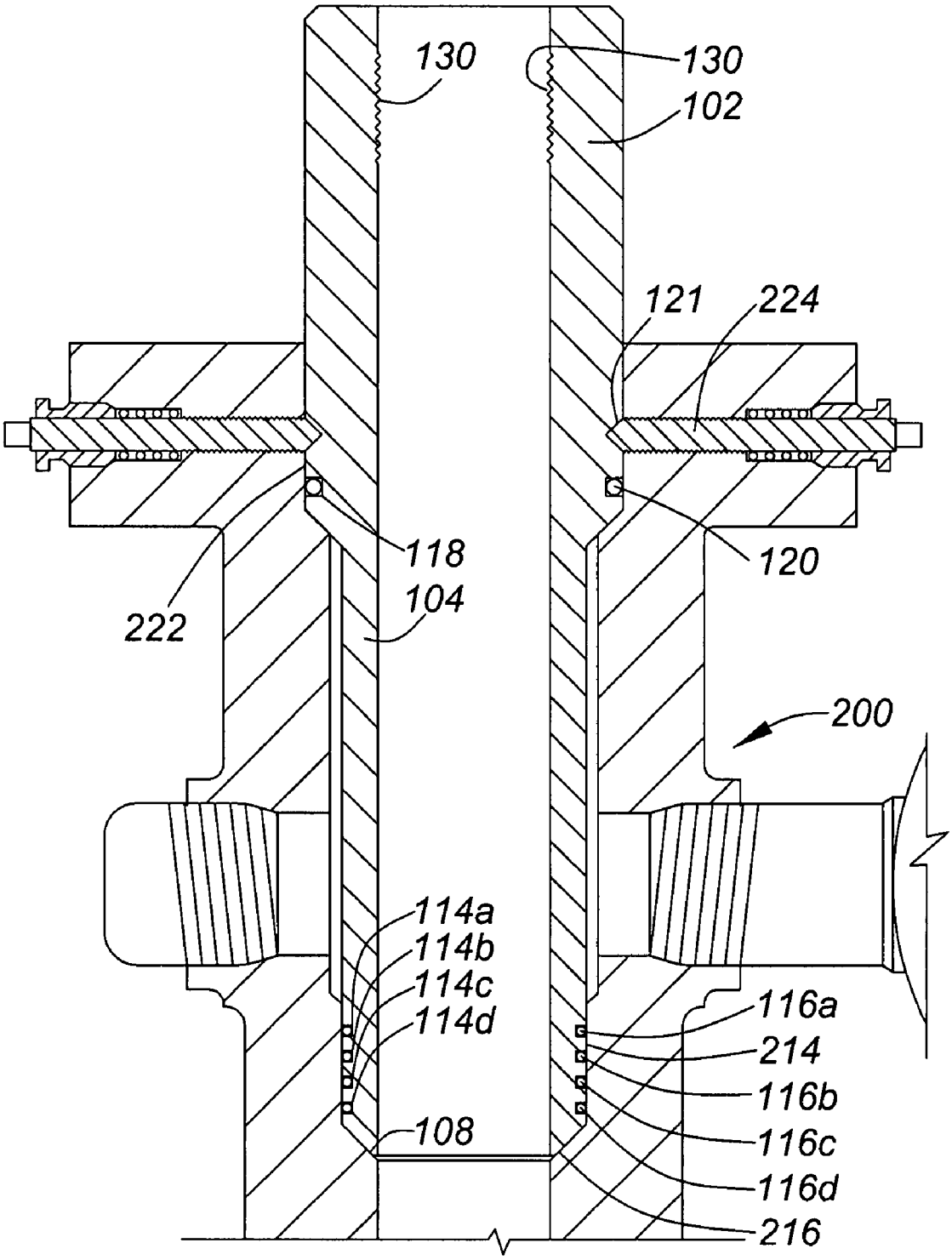
FIG. 2 is a schematic diagram of the frac mandrel shown in FIG. 1 mounted to the prior art wellhead.

FIG. 2 is a cross-sectional diagram of the frac mandrel 100 shown in FIG. 1 locked down in the prior art wellhead 200. The bottom end 104 of the frac mandrel 100 is contoured to mate with the seal bore 214 and the bit guide 216. The bottom end 104 has a bevel 108 that matches a bevel angle of the bit guide 216. Optionally, an O-ring groove (not shown) receives a high-pressure O-ring to inhibit a migration of well stimulation fluids between the bit guide 216 and the bevel 108 on the bottom end 104. At least two O-rings provide a high-pressure fluid seal between the seal bore 214 and the bottom end 104 of the frac mandrel 100. In this embodiment, four O-ring grooves 114*a*-114*d* receive O-rings 116*a*-116*d* to provide the high-pressure seal. A further high-pressure seal is provided against the tubing hanger seal bore 222 by an O-ring groove 118 that receives an O-ring 120. The frac mandrel 100 is locked in the wellhead 200, by the lock down screws 224, which engage a V-shaped annular groove 121 in the top end 102. Back pressure threads 130 secure a back pressure plug for sealing off a central passage of the frac mandrel 100, as will be explained below with reference to FIG. 9.

Figure 3:
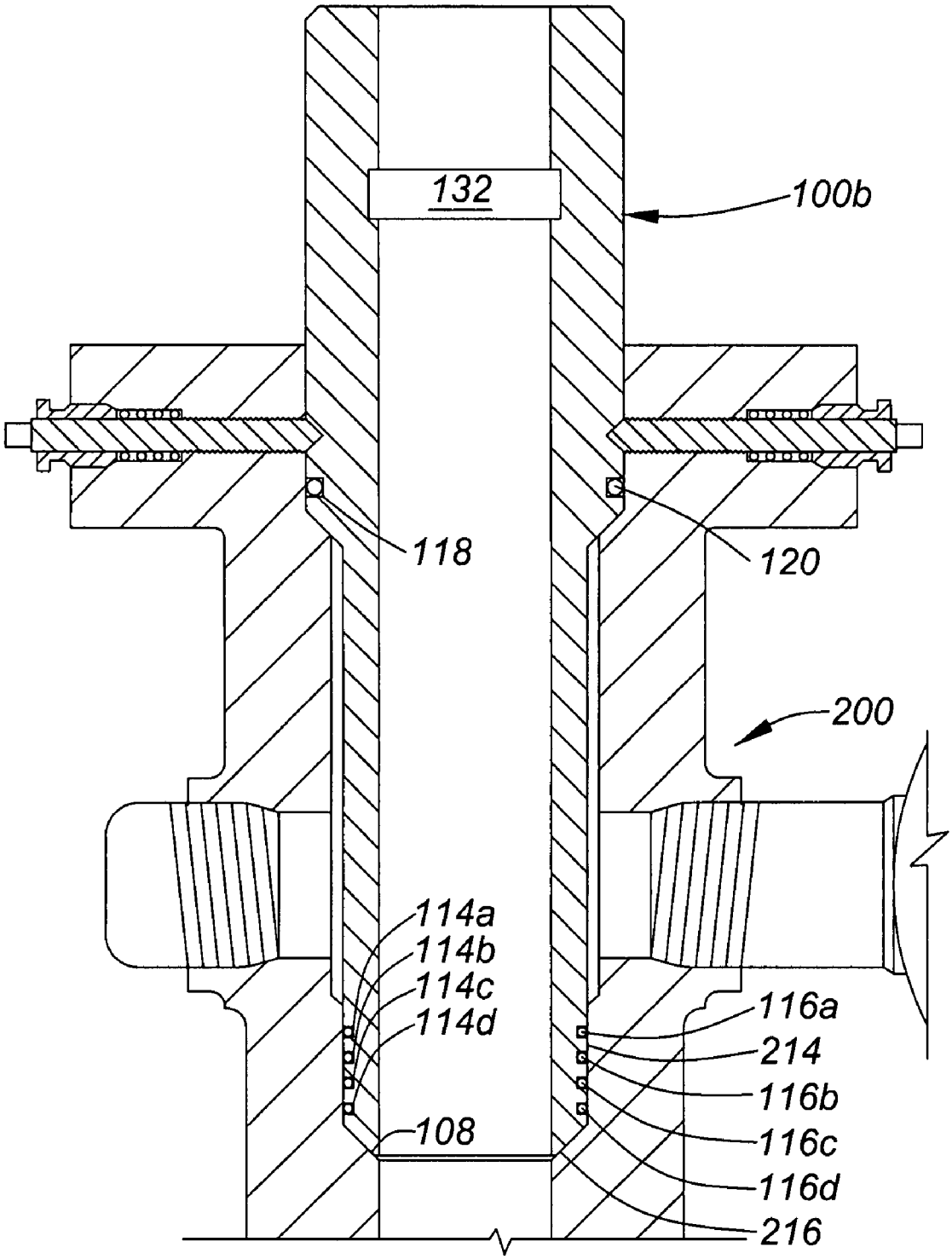
FIG. 3 is a schematic diagram of another embodiment of a frac mandrel in accordance with the invention mounted to the prior art wellhead.

FIG. 3 is a cross-sectional schematic diagram of another embodiment of the frac mandrel in accordance with the invention, generally indicated by reference number 100*b*. The frac mandrel 100*b* is identical to the frac mandrel 100 described above with reference to FIG. 2, with the exception that the back pressure threads 130 are replaced by an annular groove 132 machined in the central passage through the frac mandrel 100*b*. The annular groove 132 provides a profile that may be gripped by a hydraulic shear-off tubing plug to seal off the central passage, as will be explained below with reference to FIG. 10.

Figure 4:
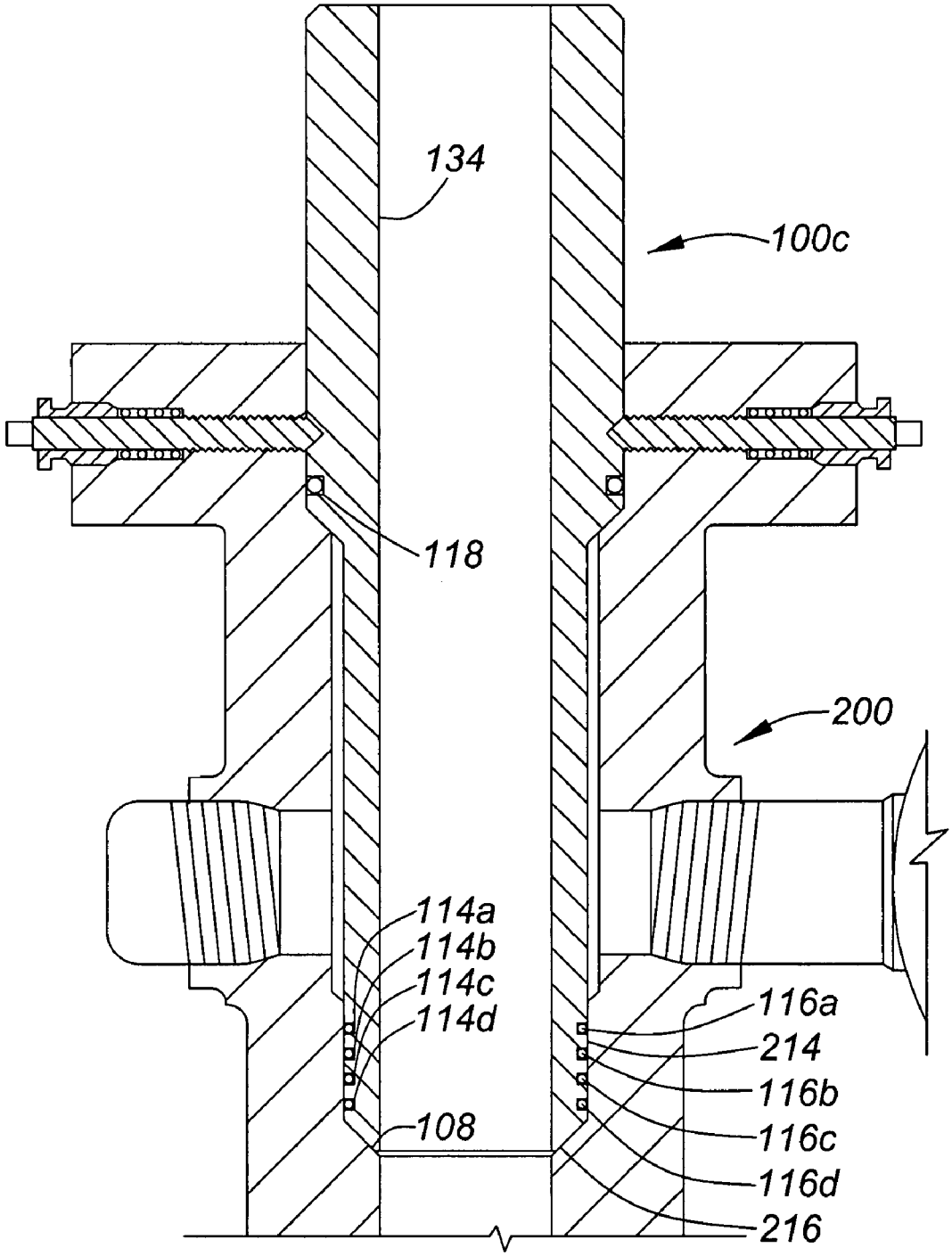
FIG. 4 is a schematic diagram of yet another embodiment of a frac mandrel in accordance with the invention mounted to the prior art wellhead.

FIG. 4 is a cross-sectional schematic diagram of yet another embodiment of the frac mandrel in accordance with the invention, generally indicated by reference number 100*c*. The frac mandrel 100*c* is identical to the frac mandrel 100 described above with reference to FIG. 2 with the exception that the top end of 102*c* has a smooth bore 134 in the central passage, in which a through-tubing plug my be set, as will be explained below with reference to FIG. 11.

Figure 5A:
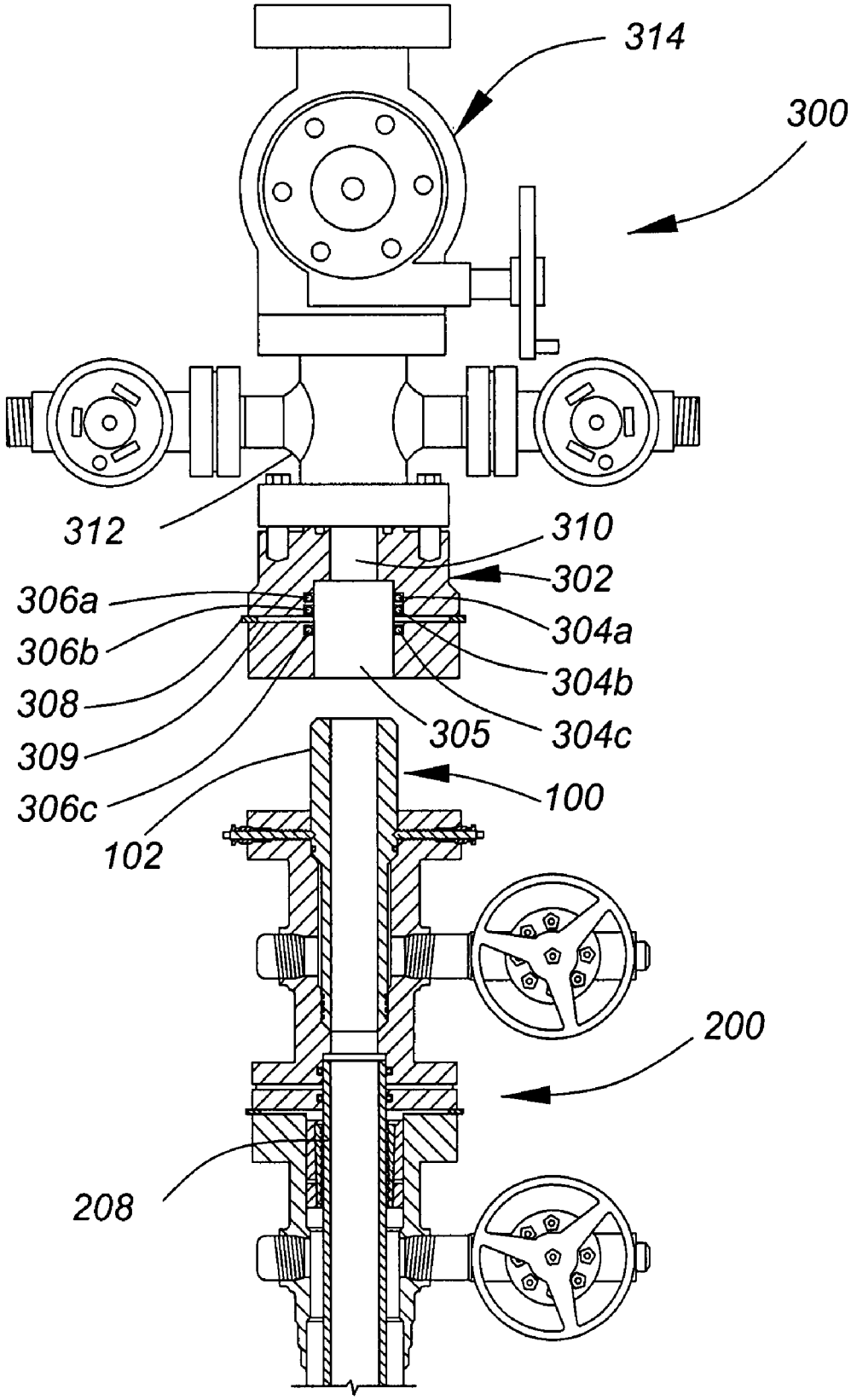
FIG. 5*a* is a schematic diagram of a well control adapter in accordance the invention with a well control stack suspended over the wellhead shown in FIG. 2.

FIG. 5*a* is a schematic diagram of the frac mandrel 100 and the prior art wellhead 200 shown in FIG. 2, with one embodiment of a well control adapter 302 and a well control stack 300 suspended over a top of the frac mandrel 100. The well control adapter 302 has an axial seal bore 305 that receives the top end 102 of the frac mandrel 100. O-ring grooves 304*a*-304*c* receive O-rings 306*a*-306*c* that provide a high-pressure fluid seal around a smooth outer periphery of the top end of the frac mandrel 100. Test port plugs 308 seal test ports 309 used to test an integrity of the high pressure seal provided by O-rings 306*a*-306*c*. An axial passage 310 in a top end of the well control adapter 302 has a diameter smaller than an outer diameter of the top end of the frac mandrel 100, but at least as large as an internal diameter of the central passage of the frac mandrel 100 and the production casing 208. The well control stack 300 includes flow control equipment, such as a cross-flow tee 312 used for pressure balancing and flow-back, and a high-pressure valve 314.

Figure 5B:
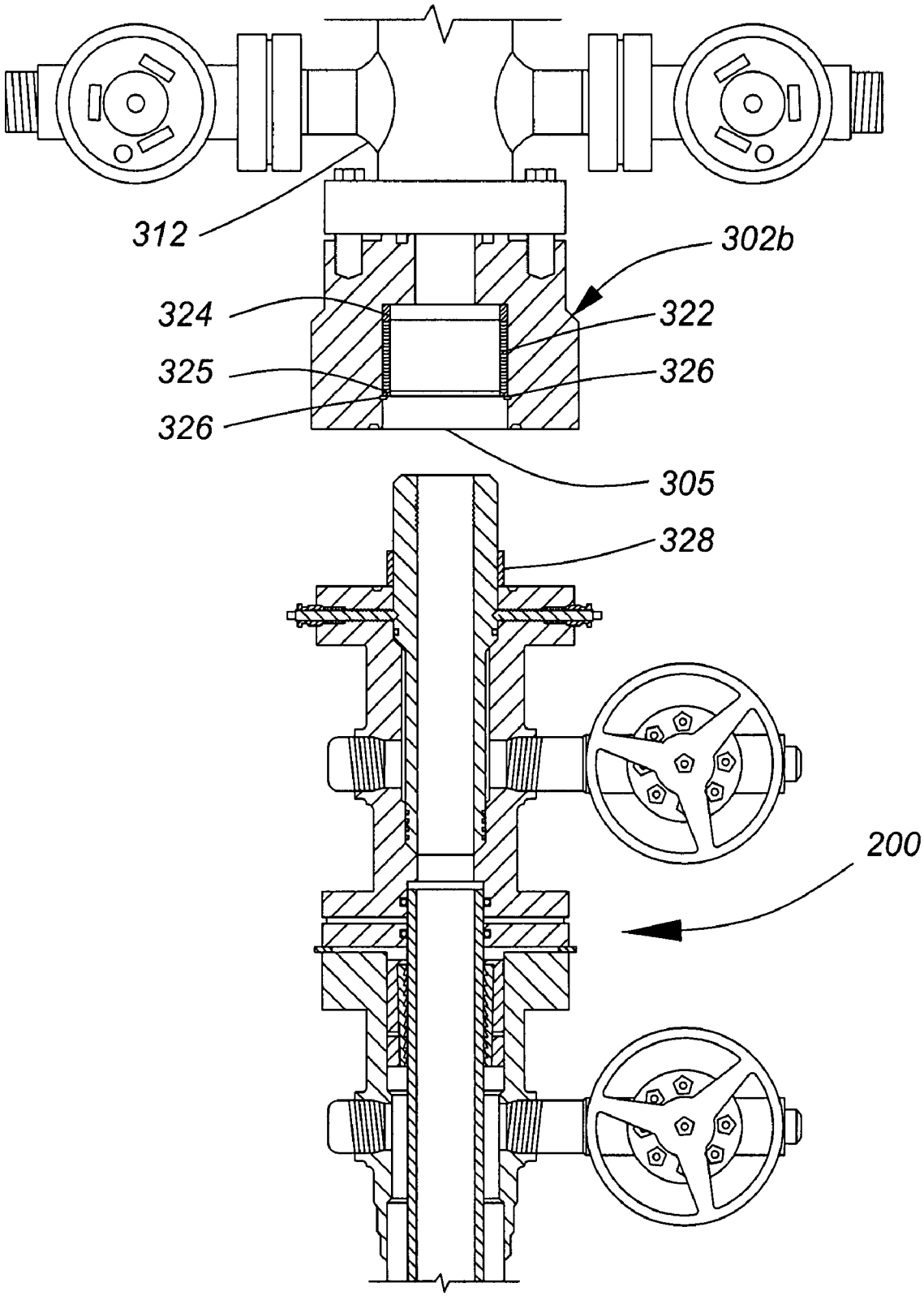
FIG. 5*b* is a schematic diagram of another embodiment of a well control adapter in accordance the invention with a well control stack suspended over the wellhead shown in FIG. 2.

FIG. 5*b* is a schematic diagram of another embodiment of a well control adapter 302*b* suspended over a top of the frac mandrel 100. The well control adapter 302*b* is identical to the well control adapter 302 described above with reference to FIG. 5*a*, except that a V-type packing is used for the high pressure seal around the top of the frac mandrel 100. In this embodiment, the V-type packing (Chevron packing, for example) is supported at a top end by a steel or brass top ring 324 having a V-shaped bottom edge, and supported on a bottom end by a steel or brass bottom ring 325 having a V-shaped groove in its top edge. The bottom ring 325 is supported by two or more pins 326 received in radial bores in the axial seal bore 305. A packing compression sleeve 328 slides over a top of the frac mandrel 100. The packing compression sleeve 328 has an outer diameter small enough to bypass the ends of the pins 326, but larger than an inner diameter of the bottom ring 325. When the well control adapter 302*b* is lowered over the top end of the frac mandrel 100, the packing compression sleeve 328 forces the bottom ring 325 upwardly to compress the V-type packing 322 around the top end of the frac mandrel 100 to provide a high pressure fluid seal.

Figure 5C:
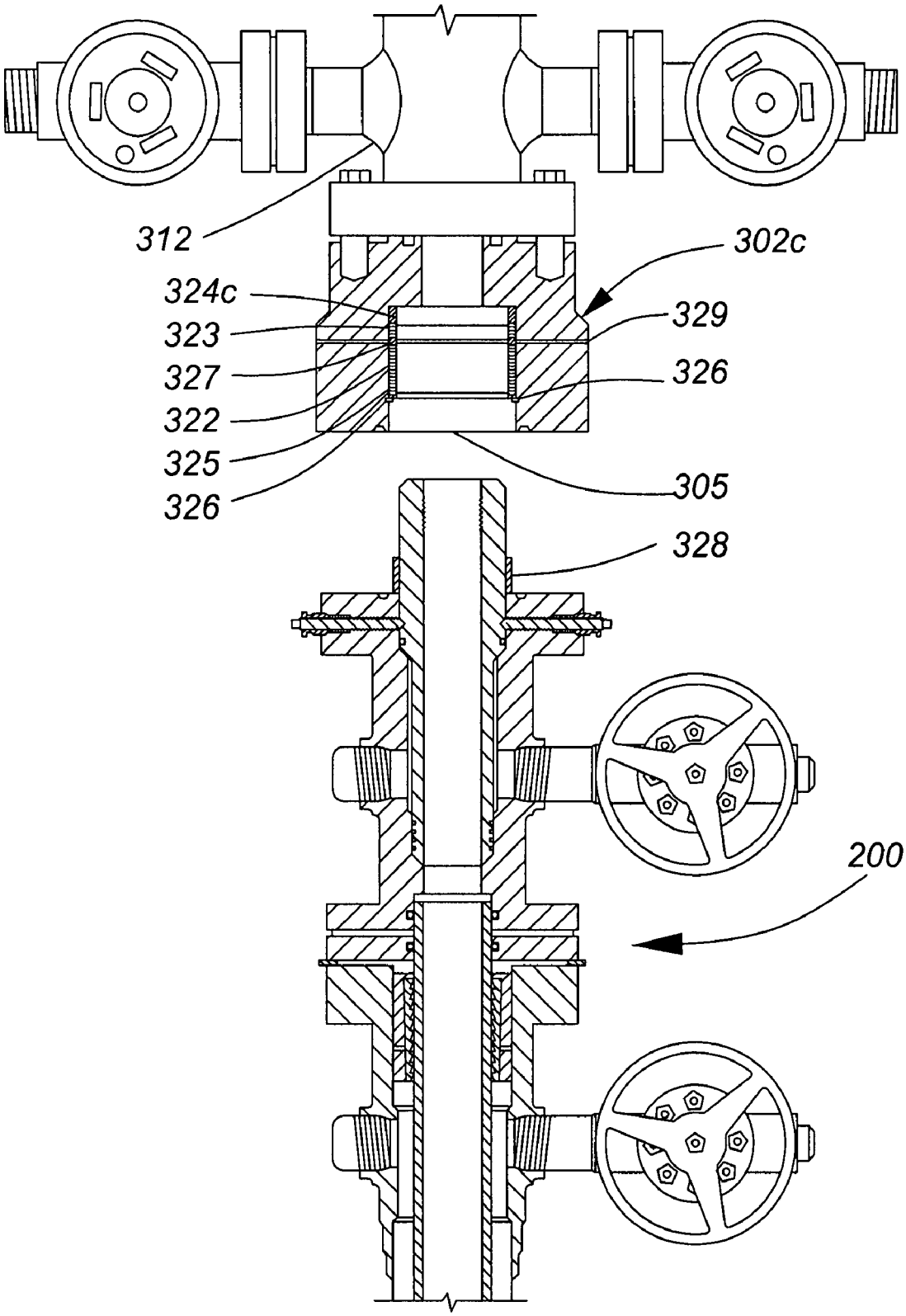
FIG. 5*c* is a schematic diagram of yet another embodiment of a well control adapter in accordance the invention with a well control stack suspended over the wellhead shown in FIG. 2.

FIG. 5*c* is a schematic diagram of yet another embodiment of a well control adapter 302*c* suspended over a top of the frac mandrel 100. The well control adapter 302*c* is identical to the well control adapter 302*b* described above with reference to FIG. 5*b*, except that the V-type packing used for the high pressure seal permits the high pressure seal to be pressure tested before a fracing operation commences. In this embodiment, a V-type packing 323 (Chevron packing, for example) is supported at a top end by a steel or brass top ring 324*c* having an inverted V-shaped groove in its bottom edge. The V-type packing 323 is inverted to contain pressure introduced through pressure test ports 329. The V-type packing 322 is supported on a bottom end by the steel or brass bottom ring 325 having the V-shaped groove in its top edge. The bottom ring 325 is supported by the two or more pins 326 received in the radial bores in the axial seal bore 305, as explained above. The packing compression sleeve 328 slides over a top of the frac mandrel 100. As explained above, the packing compression sleeve has an outer diameter small enough to bypass the ends of the pins 326, and when the well control adapter 302*b* is lowered over the top end of the frac mandrel 100, the packing compression sleeve 328 forces the bottom ring 325 upwardly to compress the V-type packing 322, 323 around the top end of the frac mandrel 100 to provide the high pressure fluid seal. A pressure test ring 327 having an inverted V-shaped top edge and a V-shaped bottom edge separates the V-type packings 322 and 323. The pressure test ring has a slightly larger internal diameter than an outer diameter of the top end of the frac mandrel 100. Small holes (not shown) drilled through the pressure test ring 100 permit pressurized fluid to be injected through the pressure test ports 329 to test an integrity of the high pressure seal provided around the top end of the frac mandrel 100 by the V-type packing 322.

Figure 5D:
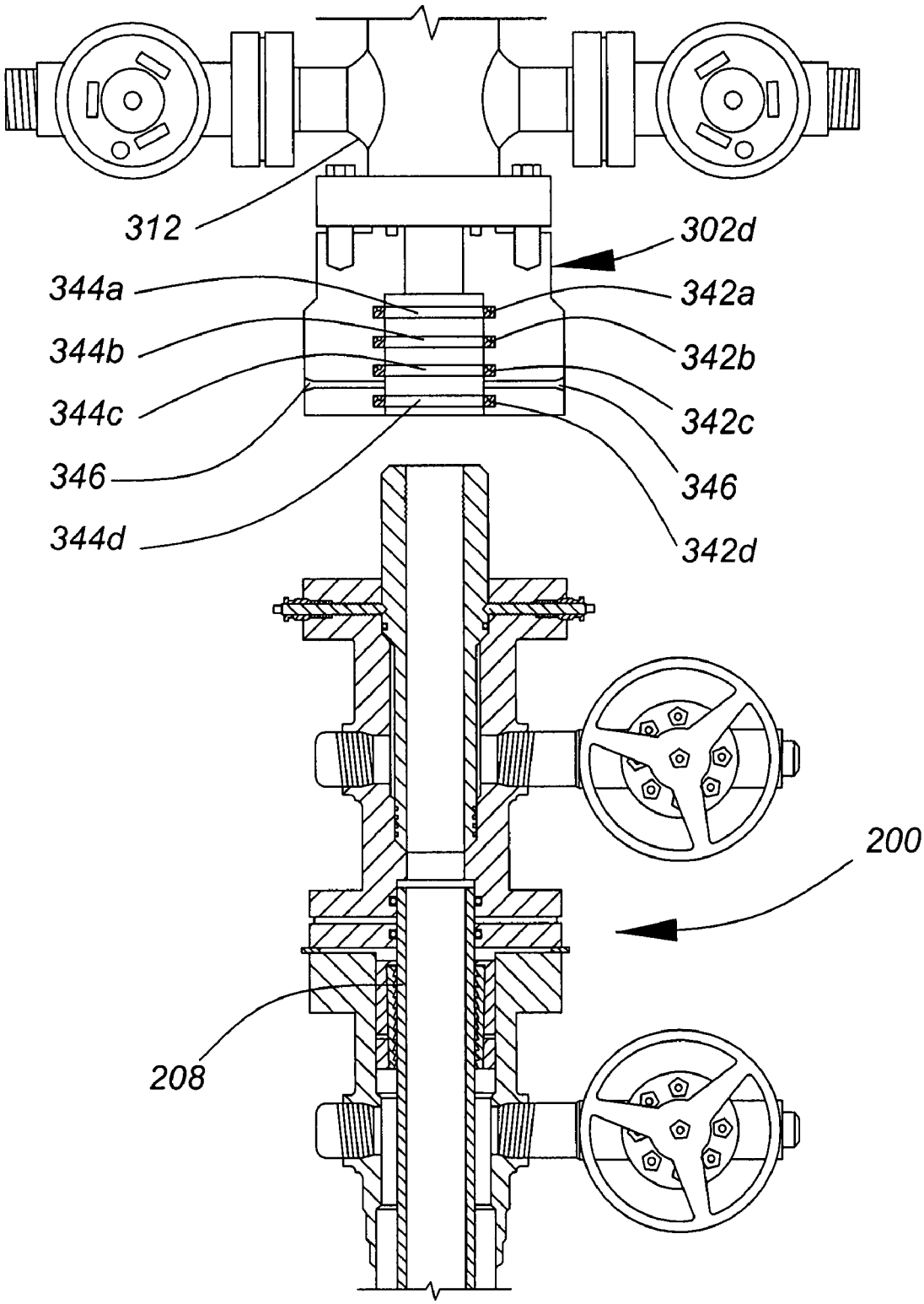
FIG. 5*d* is a schematic diagram of a further embodiment of a well control adapter in accordance the invention with a well control stack suspended over the wellhead shown in FIG. 2.

FIG. 5*d* is a schematic diagram of a further embodiment of a well control adapter 302*d* suspended over a top of the frac mandrel 100. The well control adapter 302*d* is identical to the well control adapters 302-302*c* described above with reference to FIGS. 5*a*-5*c*, except that "polypaks", which are well known in the art, are used to provide the high pressure seal. In this embodiment, four polypack grooves 342*a*-342*d* respectively receive one of four respective polypack seals 344*a*-344*d*. Each of the polypack seals 344*a*-344*d* is oriented with its sealing lip facing upwardly to provide a high pressure seal around the top end of the frac mandrel 100. Pressure monitoring ports 346 can be monitored to permit any pressure leaks between the polypacks 344*a*-344*c* and the top end of the frac mandrel 100 to be detected during a frac operation. The polypak 344*d* serves as a backup seal in the event that the polypacks 344*a*-344*c* fail during a frac operation.

Figure 5E:
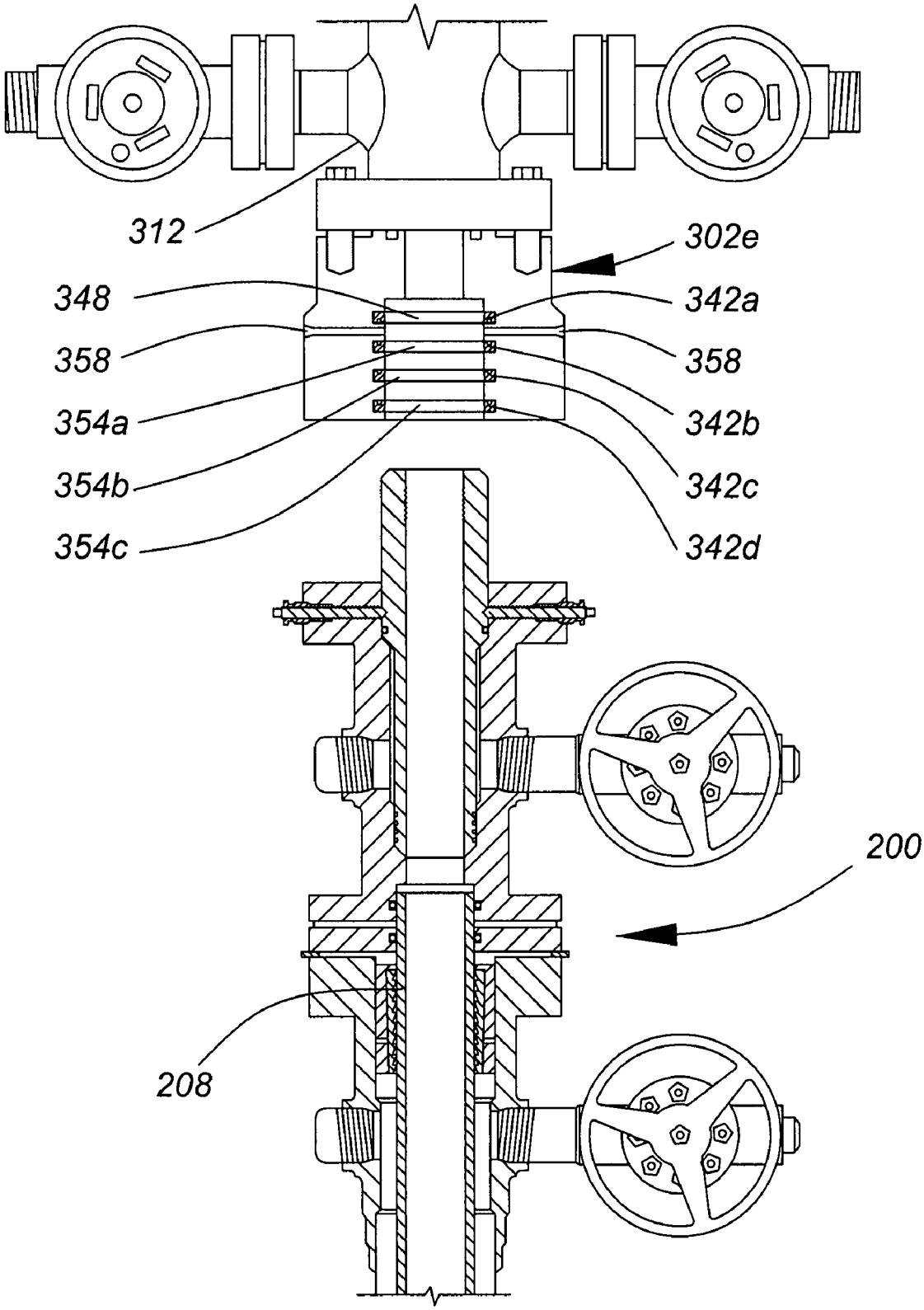
FIG. 5*e* is a schematic diagram of yet a further embodiment of a well control adapter in accordance the invention with a well control stack suspended over the wellhead shown in FIG. 2.

FIG. 5*e* is a schematic diagram of yet a further embodiment of a well control adapter 302*e* suspended over a top of the frac mandrel 100. The well control adapter 302*e* is identical to the well control adapters 302*d* described above with reference to FIGS. 5*d*, except that the polypaks are arranged to permit the high pressure seal to be tested before a fracing operation commences. In this embodiment, the four polypack grooves 342*a*-342*d* respectively receive one of four respective polypack seals. The polypack groove 342*a* receives a polypack seal 348 that has its sealing lip facing downwardly toward pressure test ports 358. The polypak seal 348 contains pressurized fluid injected through the pressure test ports 358. Each of polypack seals 354*a*-354*c* is oriented with its sealing lip facing upwardly to provide a high pressure seal around the top end of the frac mandrel 100. The pressure test ports 358 permit the high pressure seal provided by the polypak seals 354*a*-354*c* around the top end of the frac mandrel 100 to be tested before a frac operation commences, as explained above.

Although any one of well control adapters 302, 302*b*-302*e* can be used in combination with any one of the frac mandrels 100, 100*b* or 100*c*, the use of the well control adapters and the frac mandrels will now be explained with reference to frac mandrel 100 and well control adapter 302. It should be understood, however, that this combination is exemplary only.

Figure 6:
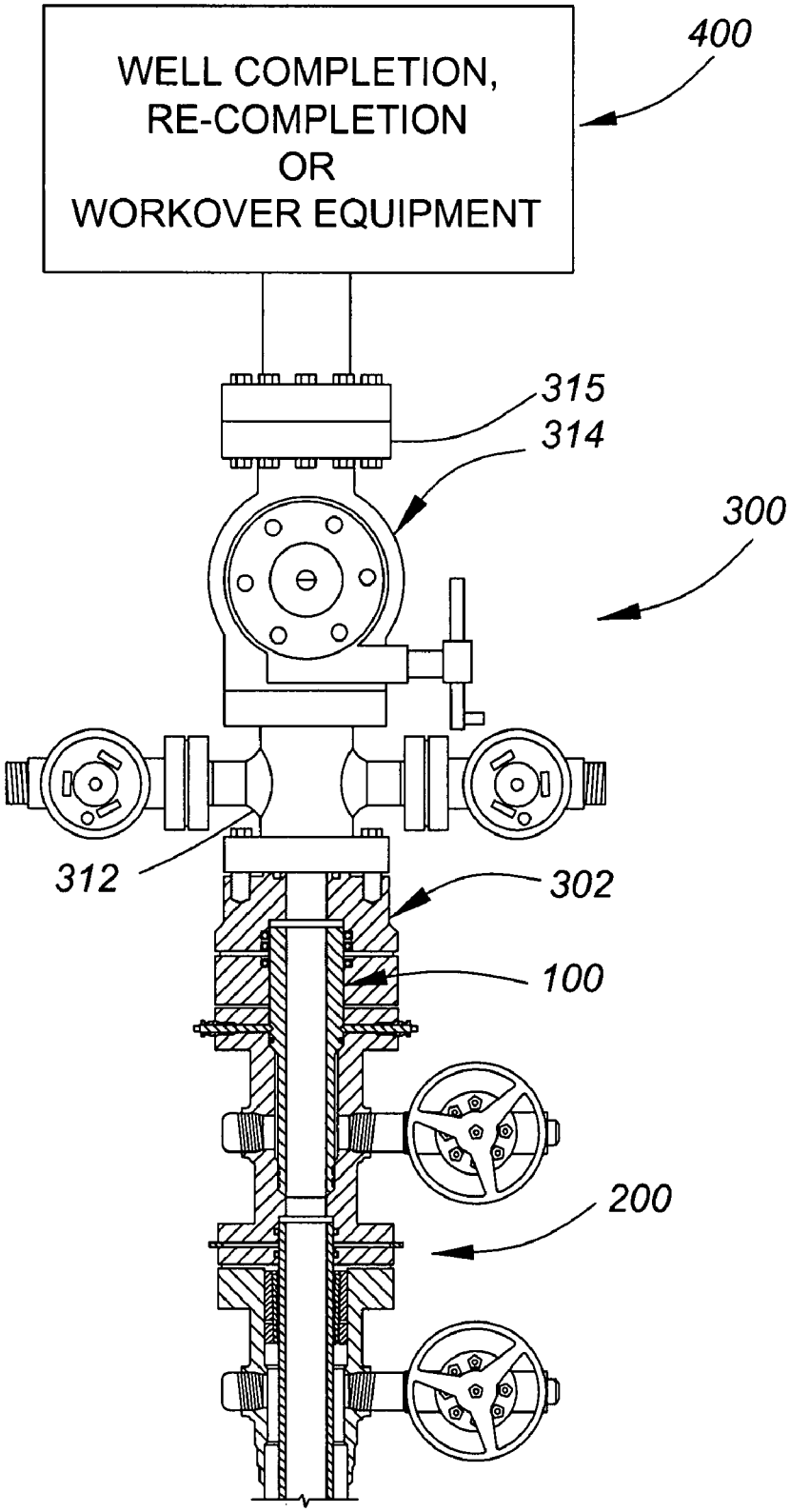
FIG. 6 is a schematic diagram of the well control adapter with the well control stack shown in FIG. 5*a* mounted to the wellhead, with well completion, re-completion or workover equipment mounted to the well control stack.

FIG. 6 is a schematic diagram of the well control adapter 302 and the well control stack 300 mounted to a top of the wellhead 200. Once the well control adapter 302 and the well control stack 300 have been mounted to the wellhead 200, well completion, re-completion or workover equipment 400 can be mounted to a top flange 315 of the high-pressure valve 314. The well completion, re-completion or workover equipment 400 may include any one or more of the following: a lubricator tube; a coil tubing injector; a wireline grease injector; a blowout preventer; a coil tubing blowout preventer; a wire line blowout preventer; a frac head; a snubbing tool; or any other tool required for well completion, re-completion or workover.

Figure 7:
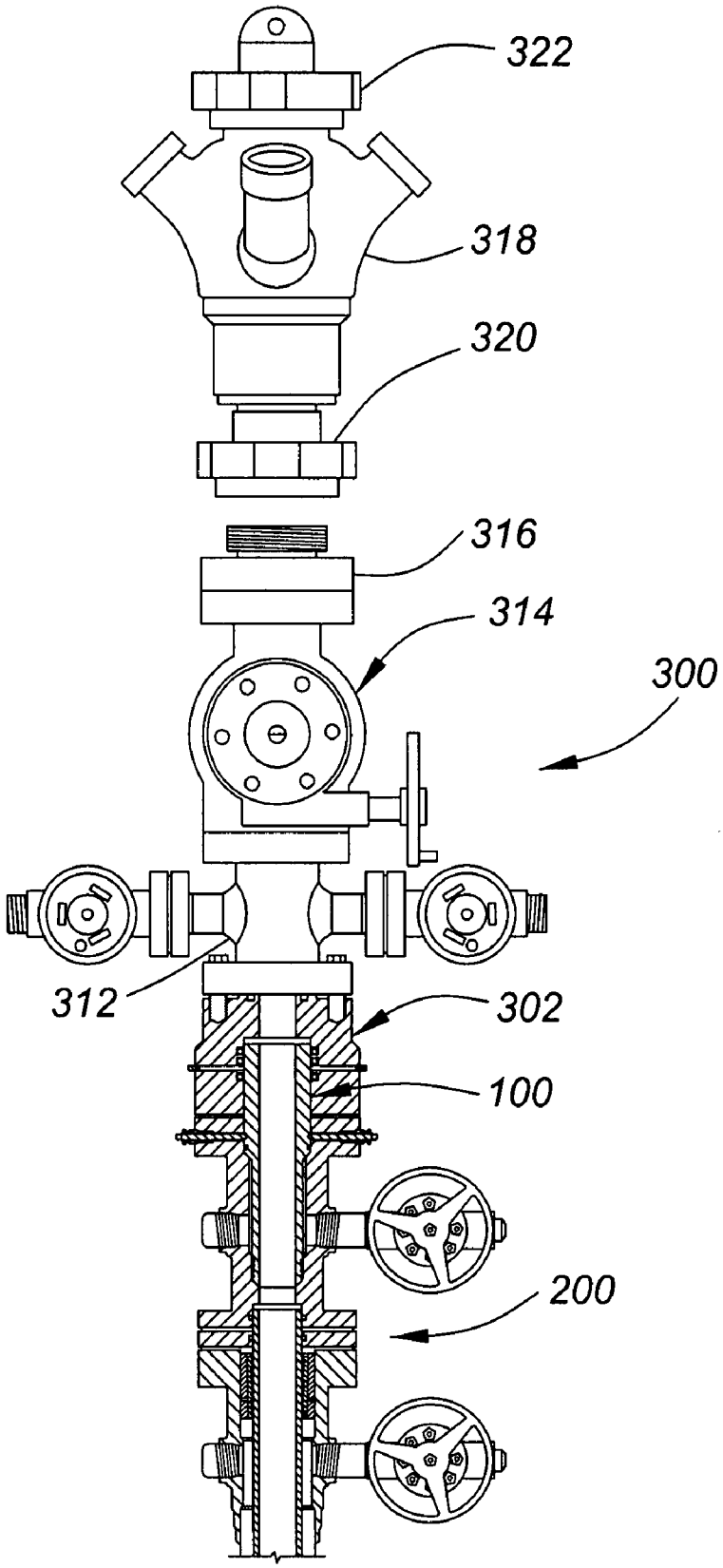
FIG. 7 is a schematic diagram of a frac head being mounted to the well control stack shown in FIG. 6.

FIG. 7 shows a frac head 318 supported by lifting sub 322 suspended over the well control stack 300. In this embodiment, threaded union adapter 316 is connected to a top of the high-pressure valve 314 and cooperates with a hammer nut 320 used to mount the frac head 318 to the well control stack 300. The frac head may also be mounted to the well control stack 300 using a bolted flange connection well known in the art.

Figure 8:
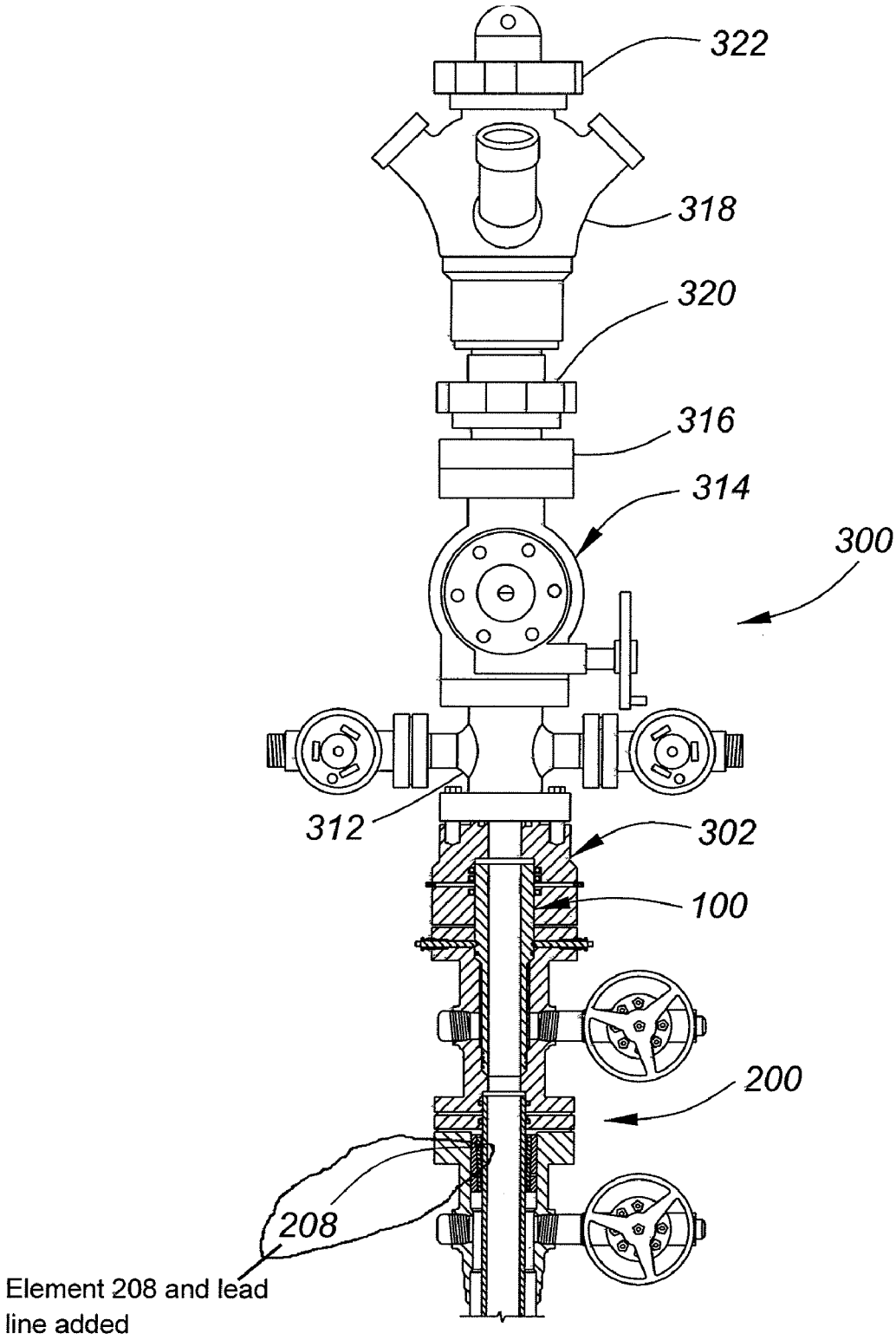
FIG. 8 is a schematic diagram of the frac head shown in FIG. 7 mounted to the well control stack.

FIG. 8 shows the frac head 318 after stimulation fluids have been pumped into the production casing 208, flowed back out of the wellbore and high pressure lines have been disconnected from the frac head 318. A lock down nut 320 secures the frac head 318 to the threaded union adapter 316. In this embodiment, the lock down nut 320 is a hammer nut well known in the art. The lock down nut 320 is released to remove the frac head 318 from the well control stack 300. As is well known in the art, stimulation of the well is generally a last step in any well completion, re-completion or workover. Consequently, after the stimulation fluids have been flowed back out of the well and the frac head 318 removed, the well is ready to be equipped for production. However, in order to equip the well for production the well control stack 300, the well control adapter 302 and the frac mandrel 100 must be removed from the wellhead 200.

Figure 9:
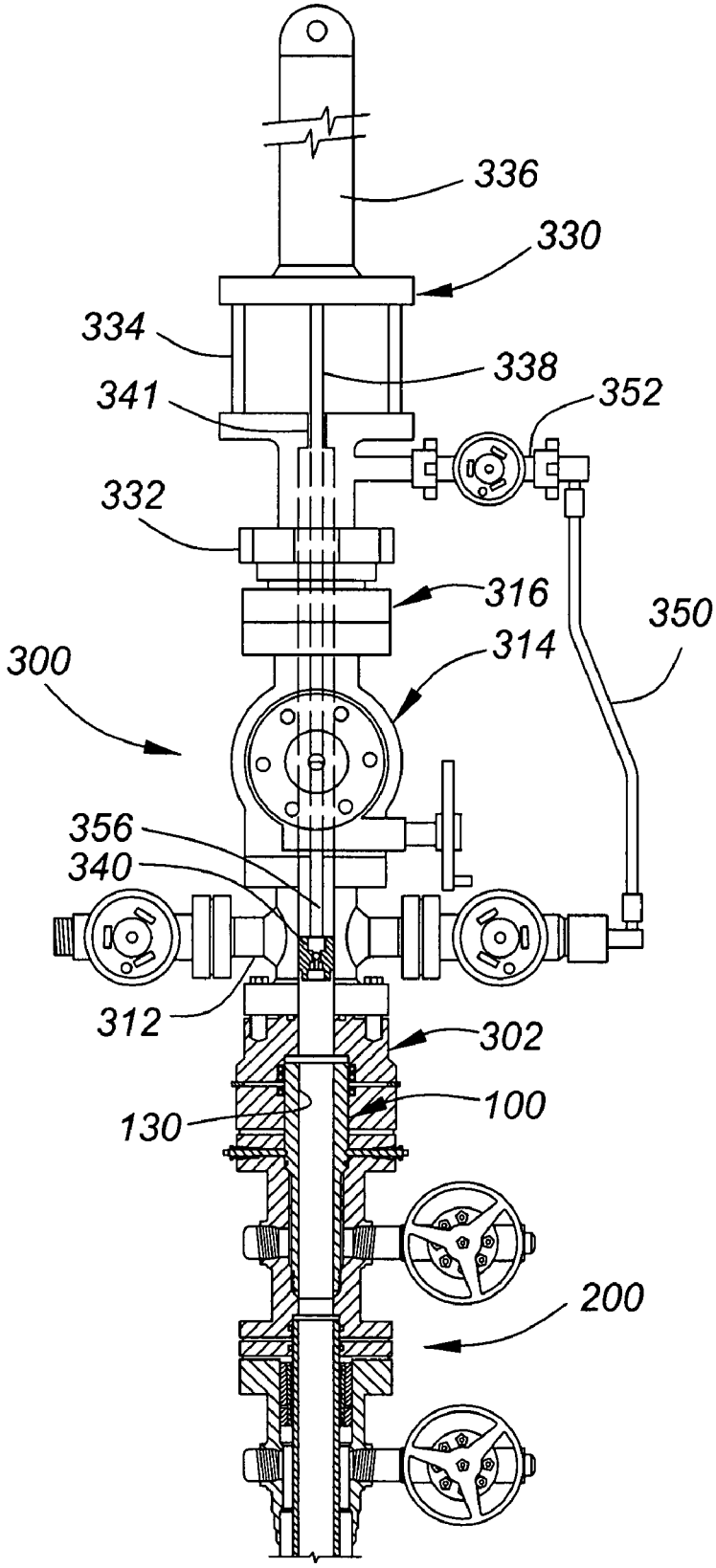
FIG. 9 is a schematic diagram of a back pressure plug tool mounted to the well control stack for setting a back pressure plug in the frac mandrel, to permit the well control adapter and the well control stack to be removed from the wellhead.

Consequently, after the frac head 318 is removed from the well control stack 300 a prior art back pressure plug setting tool 330 schematically shown in FIG. 9 is mounted to the threaded union adapter 316 using a hammer nut 332 or a flanged connection (not shown). The back pressure plug setting tool 330 includes a hydraulic injector cylinder 336 supported by plurality of stay rods 334. A cylinder rod 338 of the injector cylinder 336 is connected to a back pressure setting tool adapter 356, which in turn connects to a back pressure plug 340. The cylinder rod 338 reciprocates through a stuffing box 341, which provides a high-pressure fluid seal around the cylinder rod 338. After the back pressure plug setting tool 330 is mounted to the well control stack 300, fluid pressure is balanced across the high-pressure valve 314 using a high-pressure line 350 connected to a pressure balance port 352 of the back pressure plug setting tool 330 in a manner well known in the art. The high-pressure valve 314 is then opened, and the back pressure plug 340 is stroked down through the high-pressure valve as shown in FIG. 9.

Figure 10:
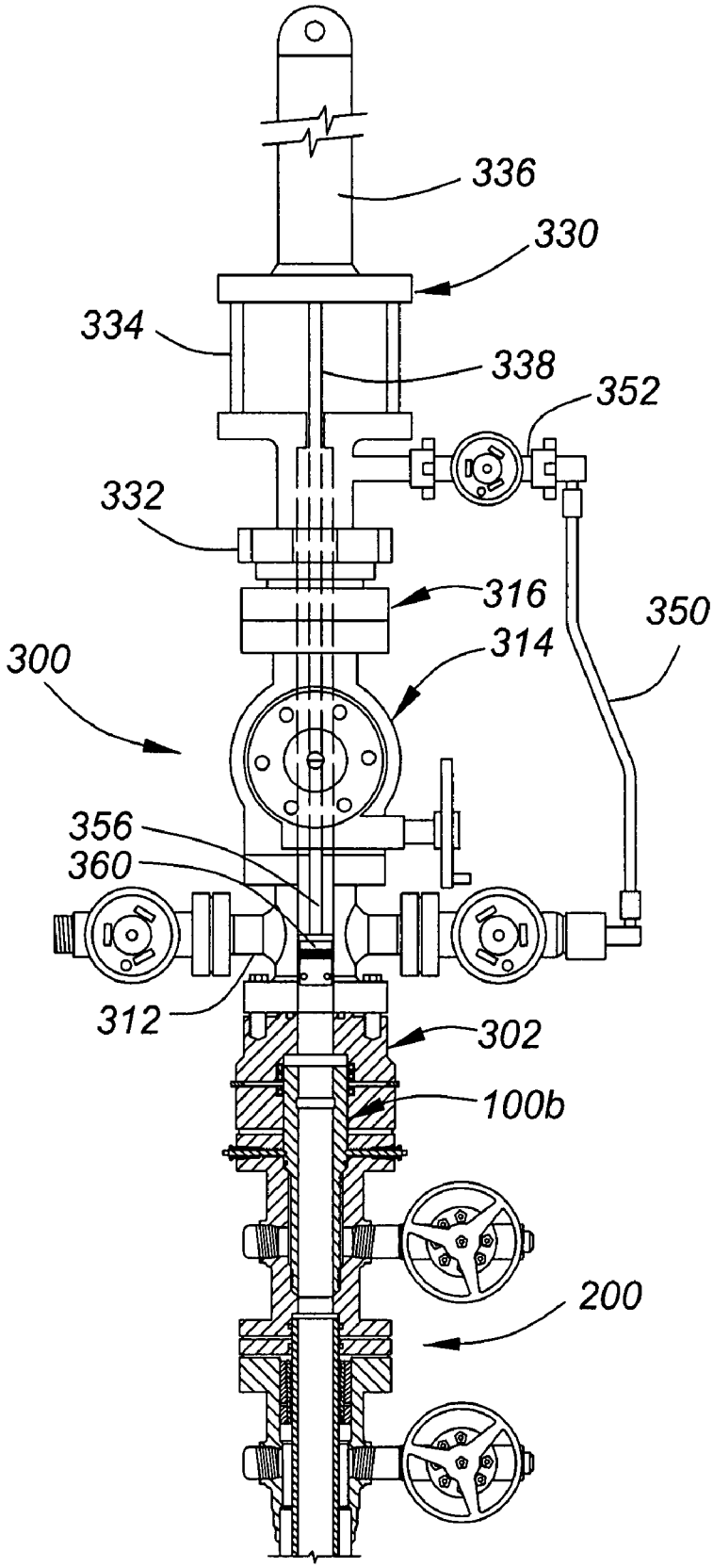
FIG. 10 is a schematic diagram of the back pressure plug tool mounted to the well control stack for setting a hydraulic shear-off tubing plug in the frac mandrel shown in FIG. 3, to permit the well control adapter and the well control stack to be removed from the wellhead.

FIG. 10 is a schematic diagram of the back pressure plug setting tool 330 being used to set a hydraulic shear-off tubing plug 360. The hydraulic shear-off tubing plug 360 is used to seal off the central passage through the frac mandrel 100*b* shown in FIG. 3. The hydraulic shear-off tubing plug 360 engages the annular groove 132 in the central passage 134 through the frac mandrel 100*b*.

Figure 11:
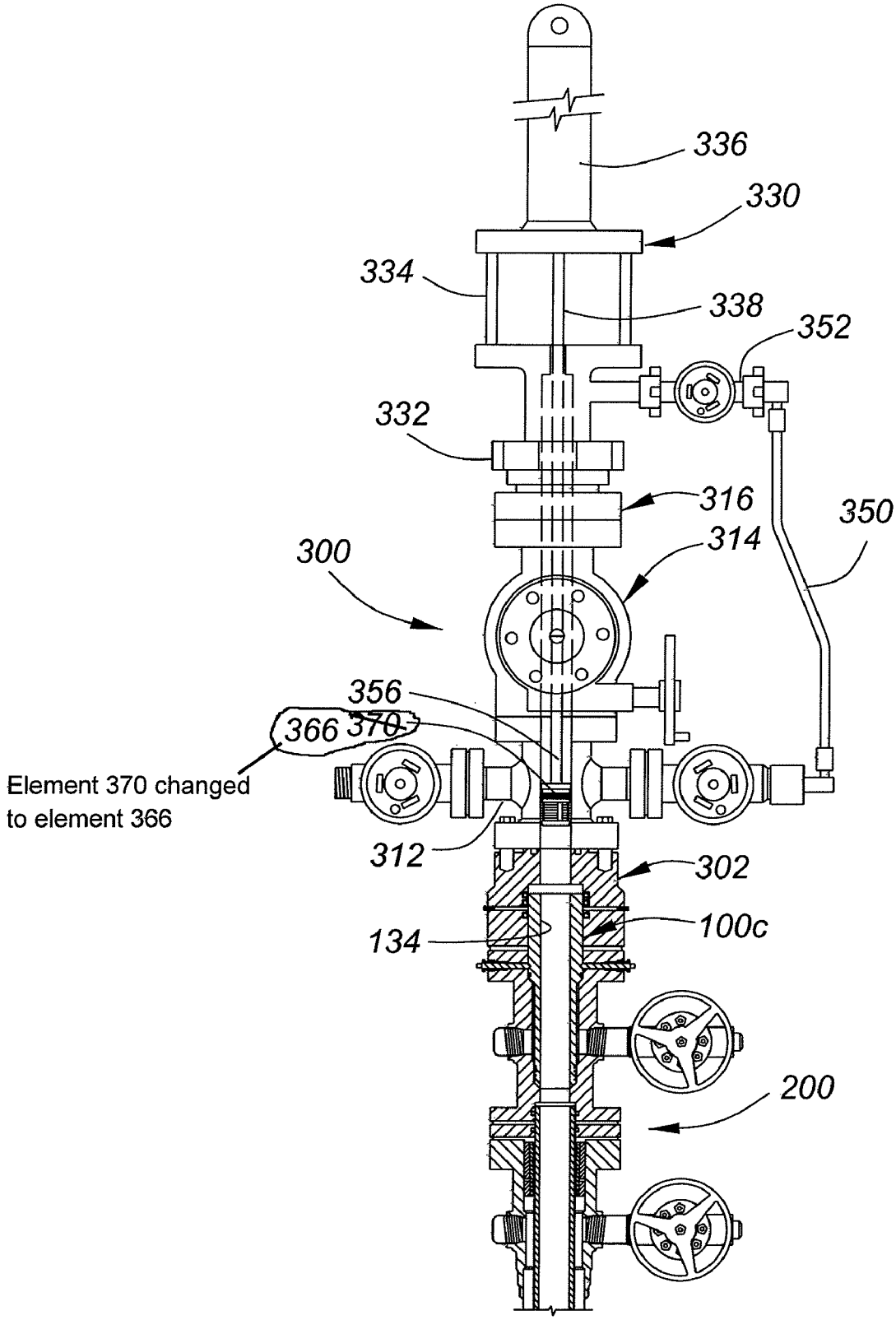
FIG. 11 is a schematic diagram of the back pressure plug tool mounted to the well control stack for setting a through-tubing plug in the frac mandrel shown in FIG. 4, to permit the well control adapter and the well control stack to be removed from the wellhead.

FIG. 11 is a schematic diagram of the back pressure plug setting tool 330 being used to set a through-tubing plug 366 in the frac mandrel 100*c*. The through-tubing plug 366 is set in the smooth bore 134 to seal off the central passage of the frac mandrel 100*c* shown in FIG. 4. The through-tubing plug 366 is, for example, a PosiSet® through-tubing plug manufactured by Schlumberger Corporation.

Figure 12:
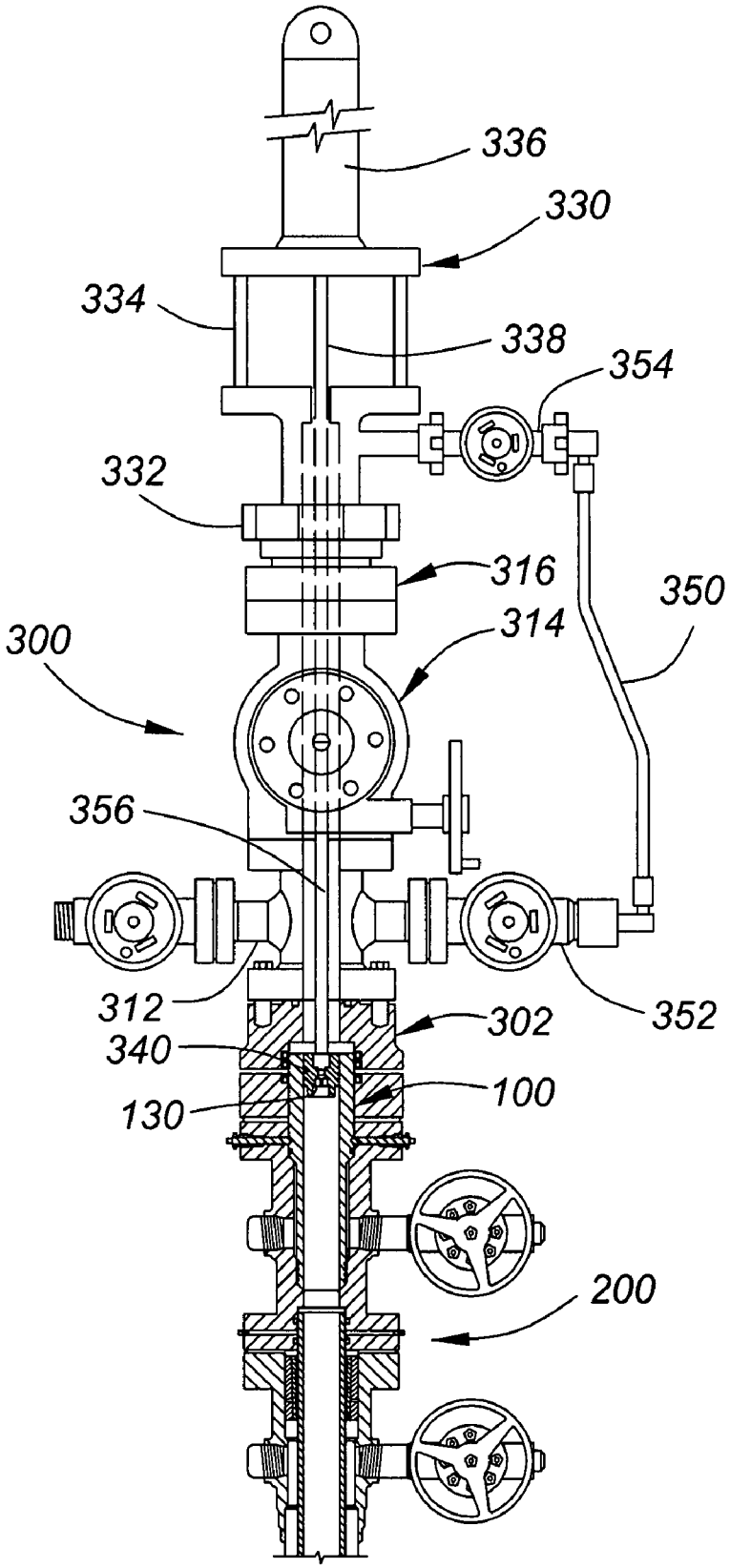
FIG. 12 is a schematic diagram of the frac mandrel shown in FIG. 9 with the back pressure plug in a set condition.
Figure 13:
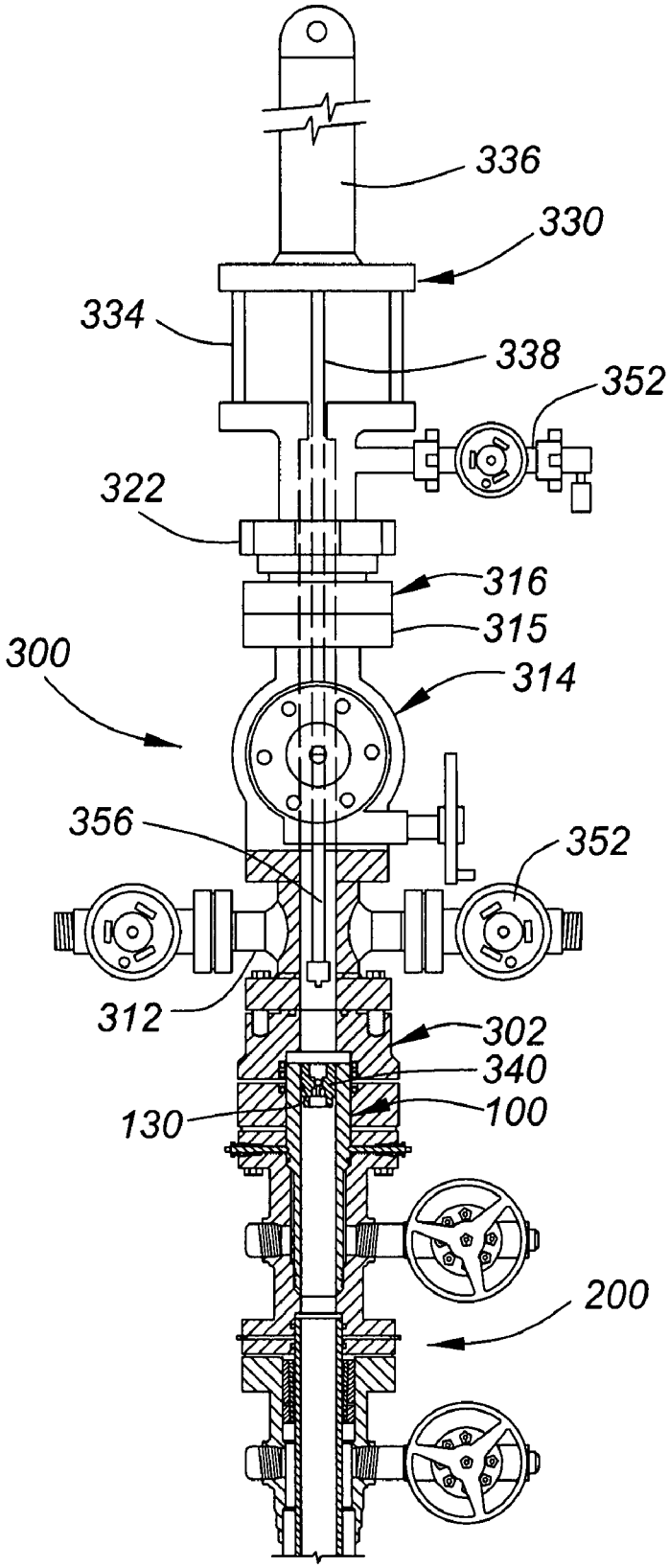
FIG. 13 is a schematic diagram of the frac mandrel and the well control stack shown in FIG. 12 with a back pressure plug setting tool disengaged from the back pressure plug.

FIG. 12 is a schematic diagram of the back pressure plug 340 after it has been stroked through the well control stack 300 and the well control adapter 302, and secured by the back pressure threads 130. As is well understood in the art, the back pressure plug threads 130 are right-handed threads, whereas the back pressure plug tool adapter 356 engages the back pressure plug 340 with a left-handed thread. Consequently, once the back pressure plug 340 is firmly engaged with the back pressure plug threads 130, the back pressure plug tool adapter 356 can be further rotated to release it from the back pressure plug 340, as shown in FIG. 13. The back pressure plug setting tool 330 is then removed from the well control stack 300 by releasing the hammer nut 322 after the back pressure plug tool adapter 356 is stroked up through the well control stack 300, the high pressure valve 314 is closed, and pressure above the backpressure plug 340 is bled off through the pressure balance port 352.

Figure 14:
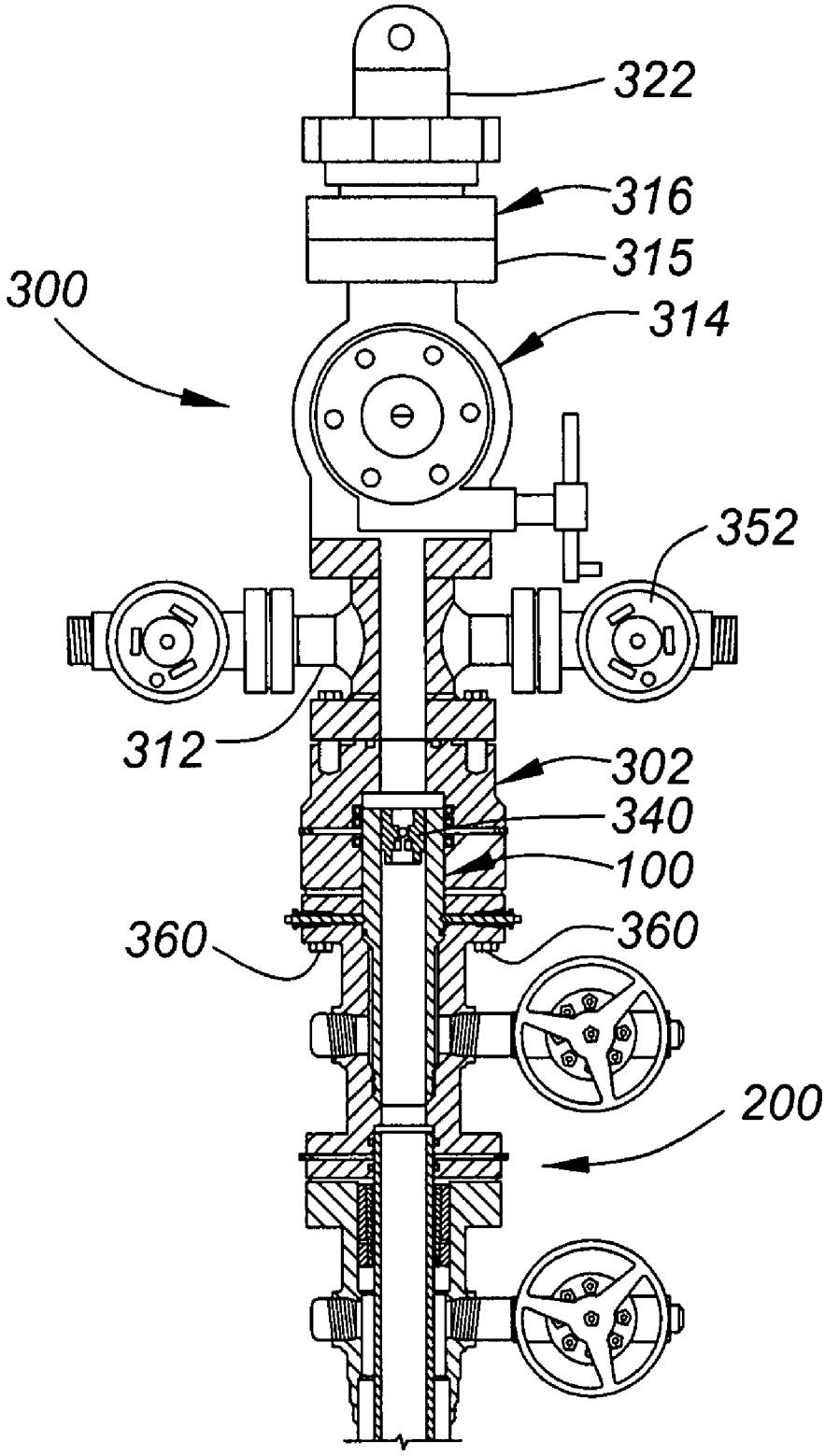
FIG. 14 is a schematic diagram of the well control stack with the backpressure plug setting tool removed and a lifting sub connected to a top of the well control stack.
Figure 15:
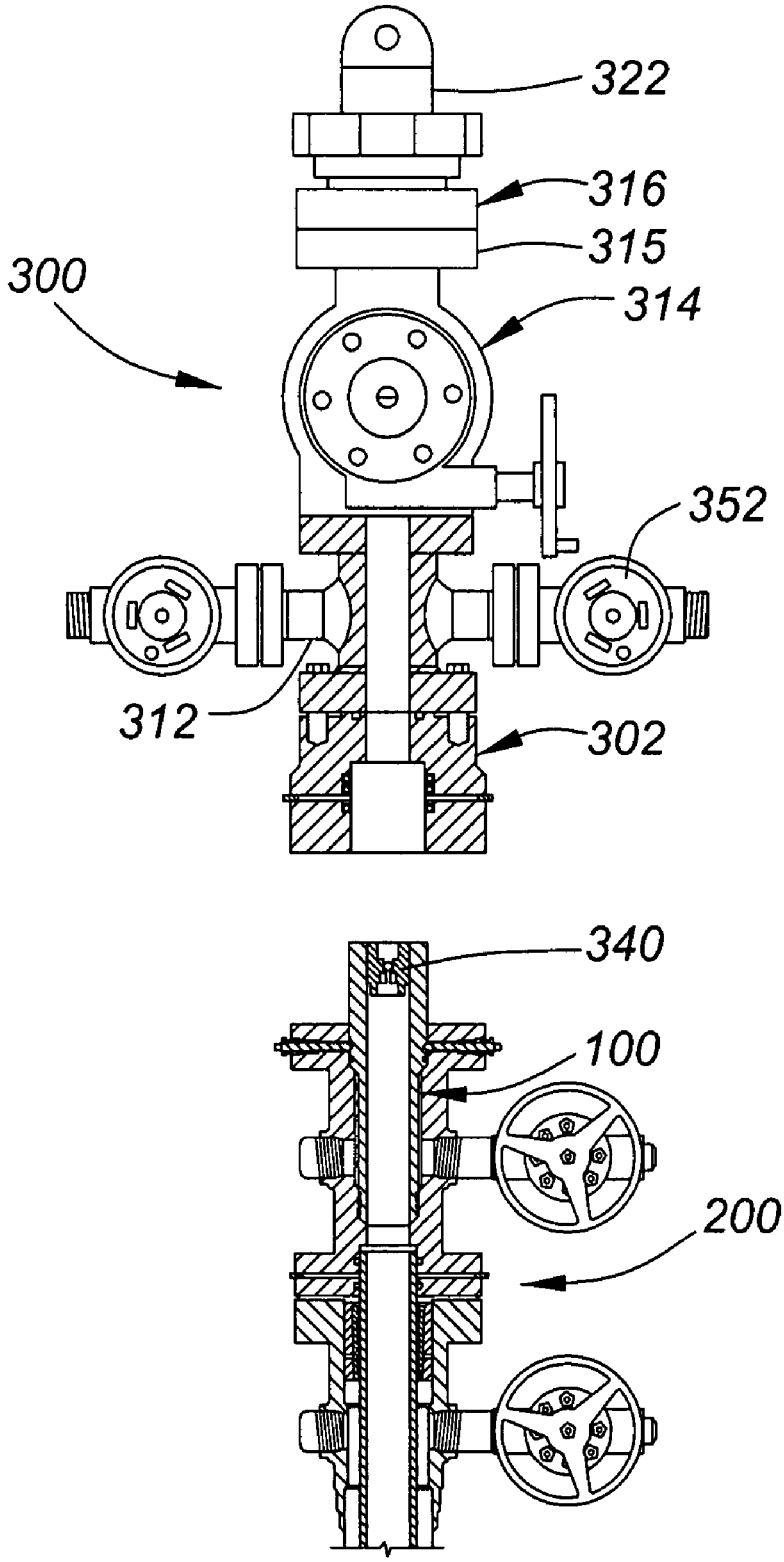
FIG. 15 is a schematic diagram of the well control adapter and the well control stack removed from the wellhead shown in FIG. 2.

As shown in FIG. 14, the lifting sub 322 is then connected to the threaded union adapter 316. The well control stack 300 and the well control adapter 302 are removed from the wellhead 200 after studs 360 are removed. FIG. 15 shows the well control stack 300 and the well control adapter 302 being hoisted away from the wellhead 200 using the lifting sub 322.

Figure 16:
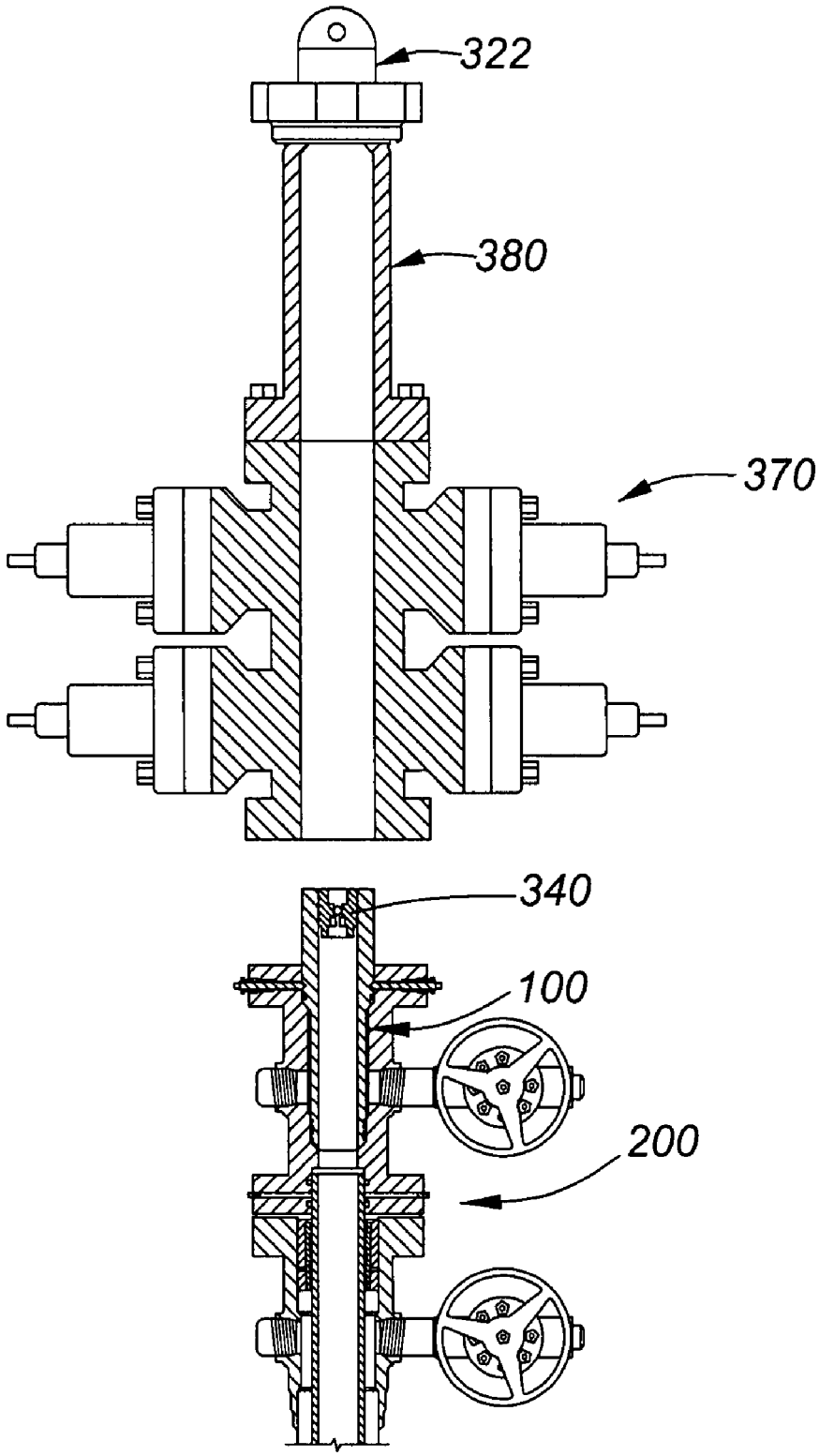
FIG. 16 is a schematic diagram of a blowout preventer with a lubricator tube being hoisted onto the wellhead in order to remove the frac mandrel from the wellhead.

FIG. 16 shows the lifting sub 322 been used to mount a blowout preventer 370 and a lubricator tube 380 to the wellhead 200 after the well control stack 300 and the well control adapter 302 have been removed as shown in FIG. 15.

Figure 17:
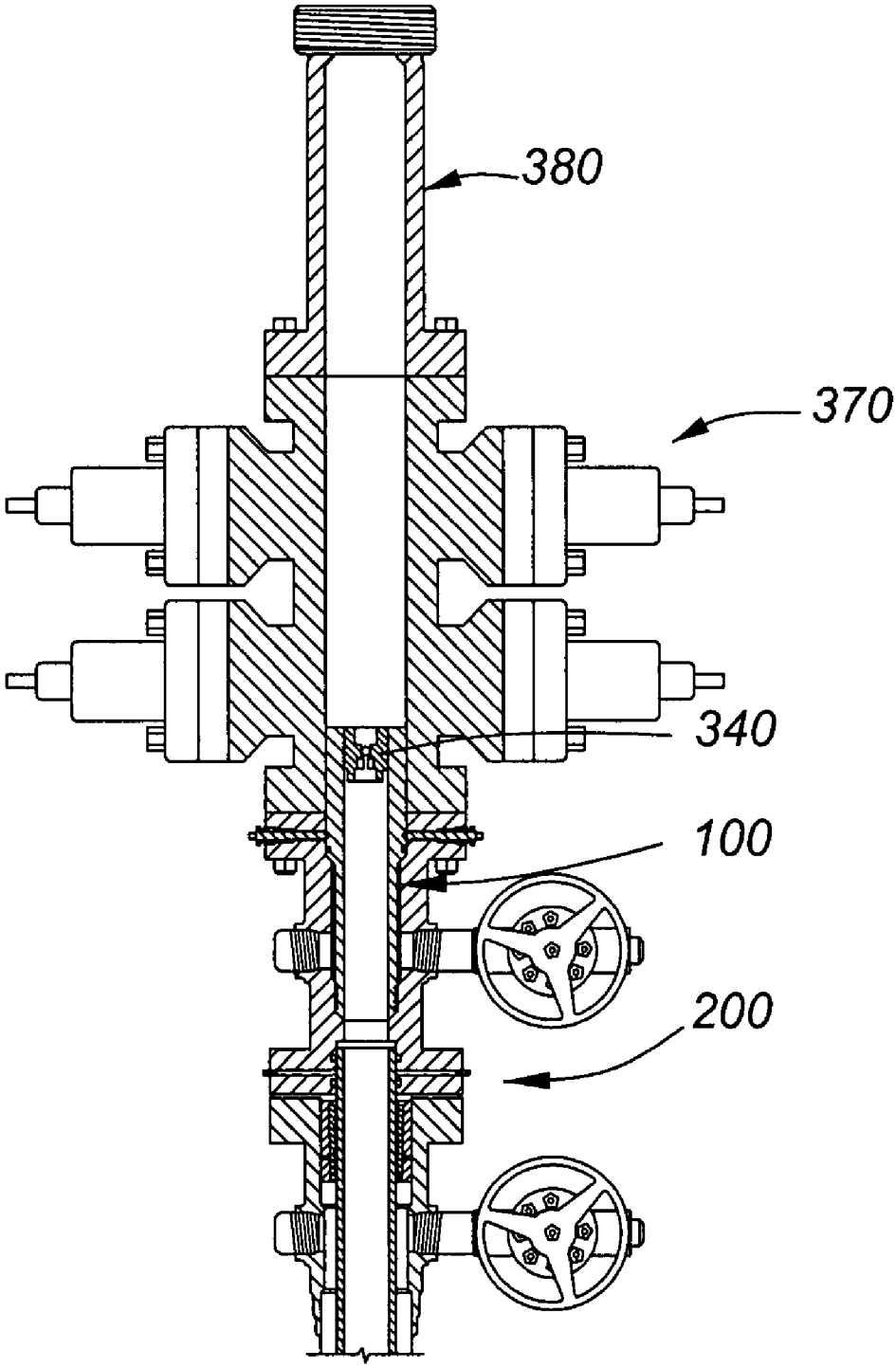
FIG. 17 is a schematic diagram of the blowout preventer and the lubricator tube mounted to a top of the wellhead.

The blowout preventer 370 and lubricator tube 380 mounted to wellhead 200 is shown in FIG. 17.

Figure 18:
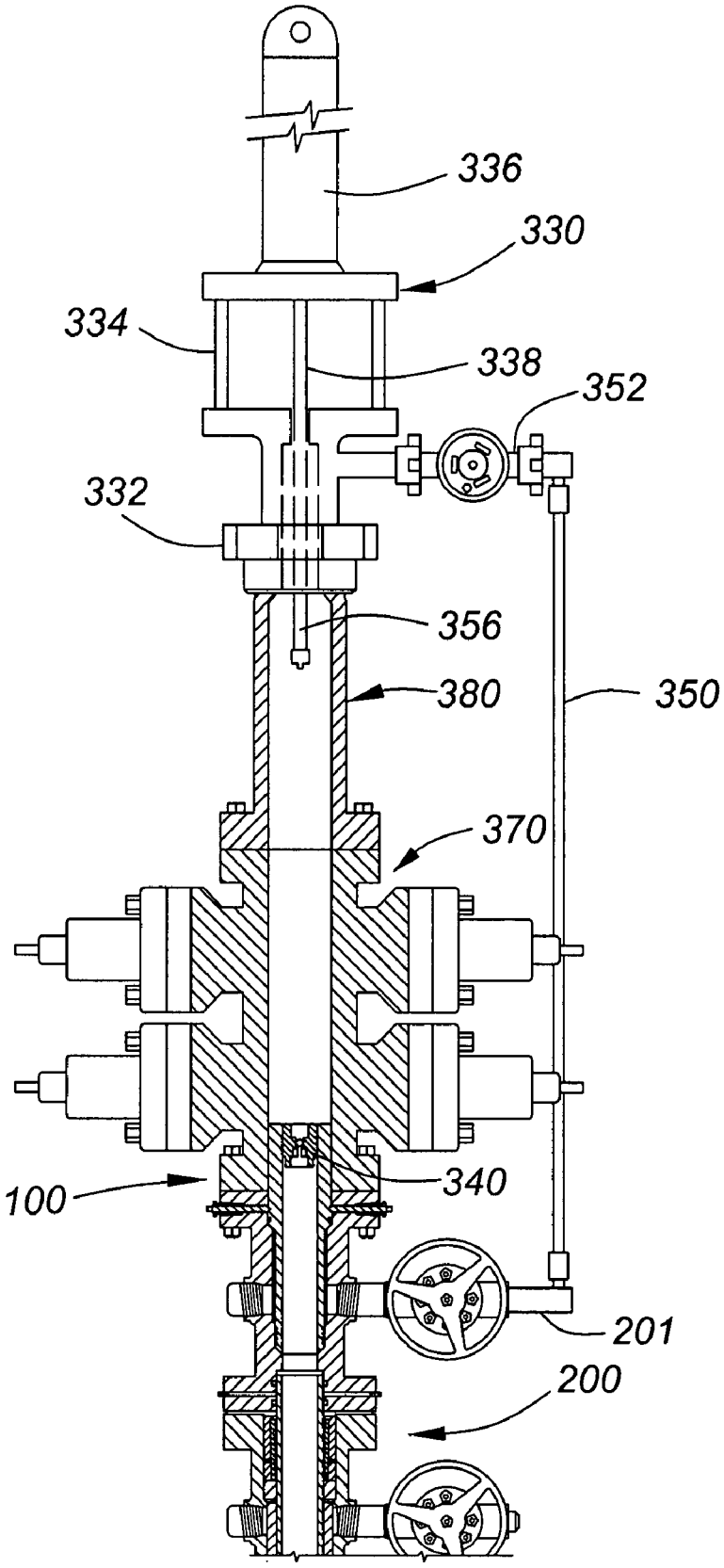
FIG. 18 is a schematic diagram of the back pressure plug setting tool mounted to a top of the lubricator tube shown in FIG. 17.

As shown in FIG. 18, the back pressure plug setting tool 330 is then mounted to a top of the lubricator tube 380 using the hammer nut 332 or flange bolts (not shown). The back pressure plug tool adapter 356 is stroked down through the lubricator tube 380 and the blowout preventer 370 and connected to the back pressure plug 304 as shown in FIG. 19.

Figure 19:
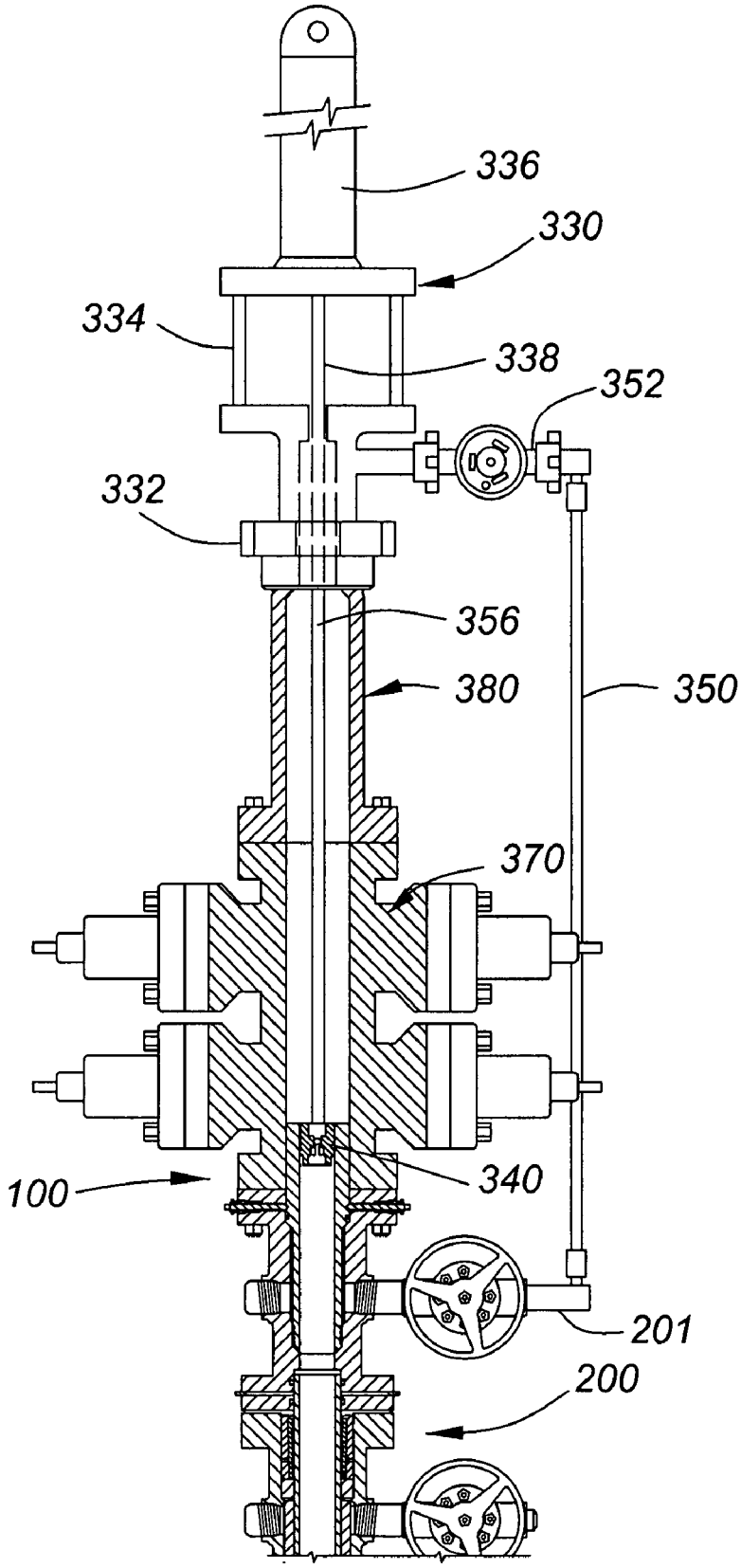
FIG. 19 is a schematic diagram of the back pressure plug setting tool connected to the back pressure plug in order to retrieve the frac mandrel from the wellhead.
Figure 20:
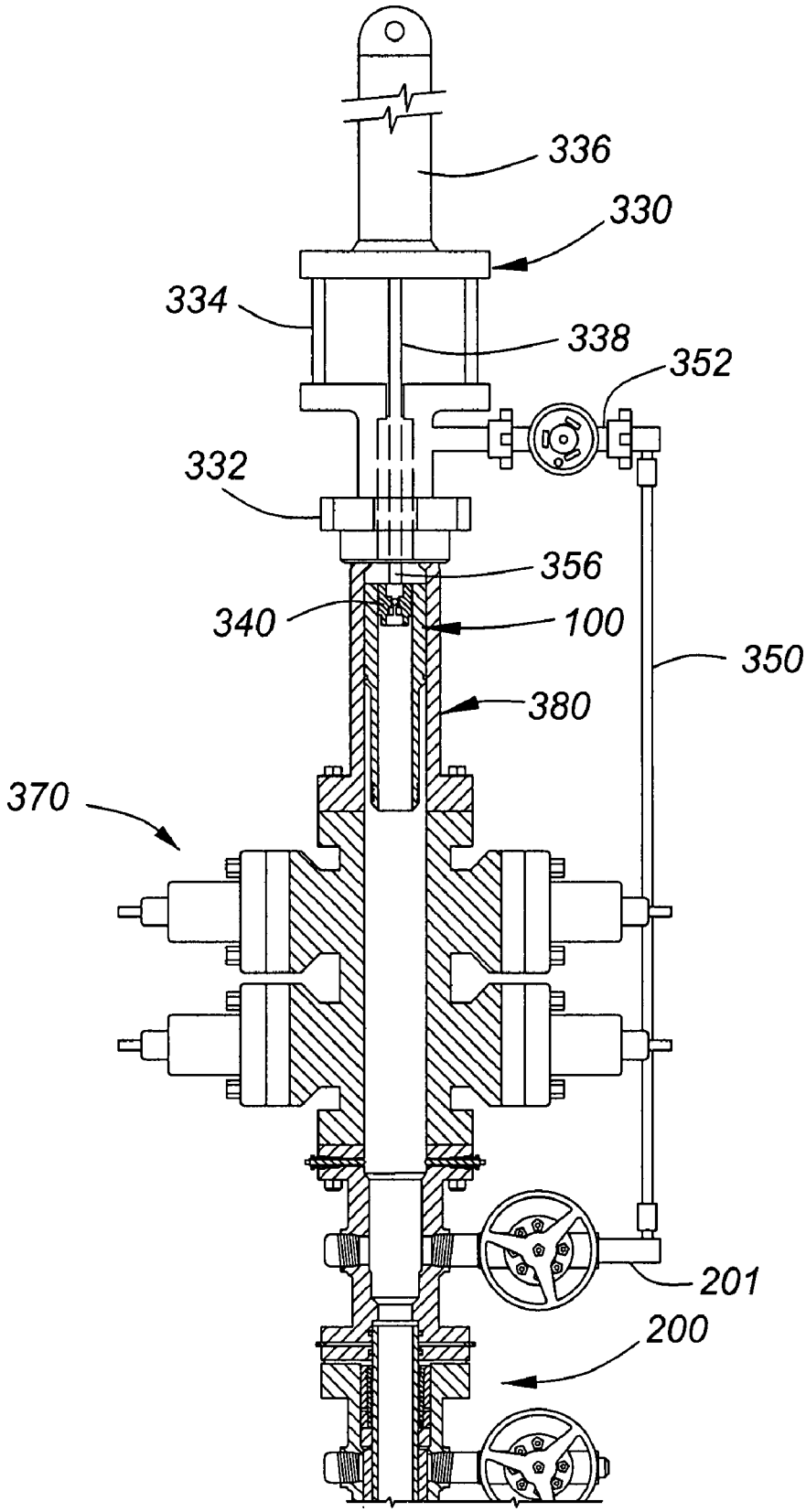
FIG. 20 is a schematic diagram of the frac mandrel drawn into the lubricator tube.

Well pressure is then balanced across the frac mandrel 100 using a high-pressure line connected between the side port 201 and the pressure balance port 352, as shown in FIG. 19. The lockdown screws 224 (see FIG. 2) are then backed off to release the frac mandrel 100, and the hydraulic cylinder 336 of the back pressure plug setting tool 330 is operated to pull the frac mandrel 100 up into the lubricator tube 380 as shown in FIG. 20. Once the frac mandrel 100 is drawn up into lubricator tube 380, blind rams of the blowout preventer 370 are closed to control the well, the high-pressure line 350 is disconnected and pressure is bled off through the pressure balance port 352 to permit the lubricator tube 380 to be disconnected from the blowout preventer 370.

Figure 21:
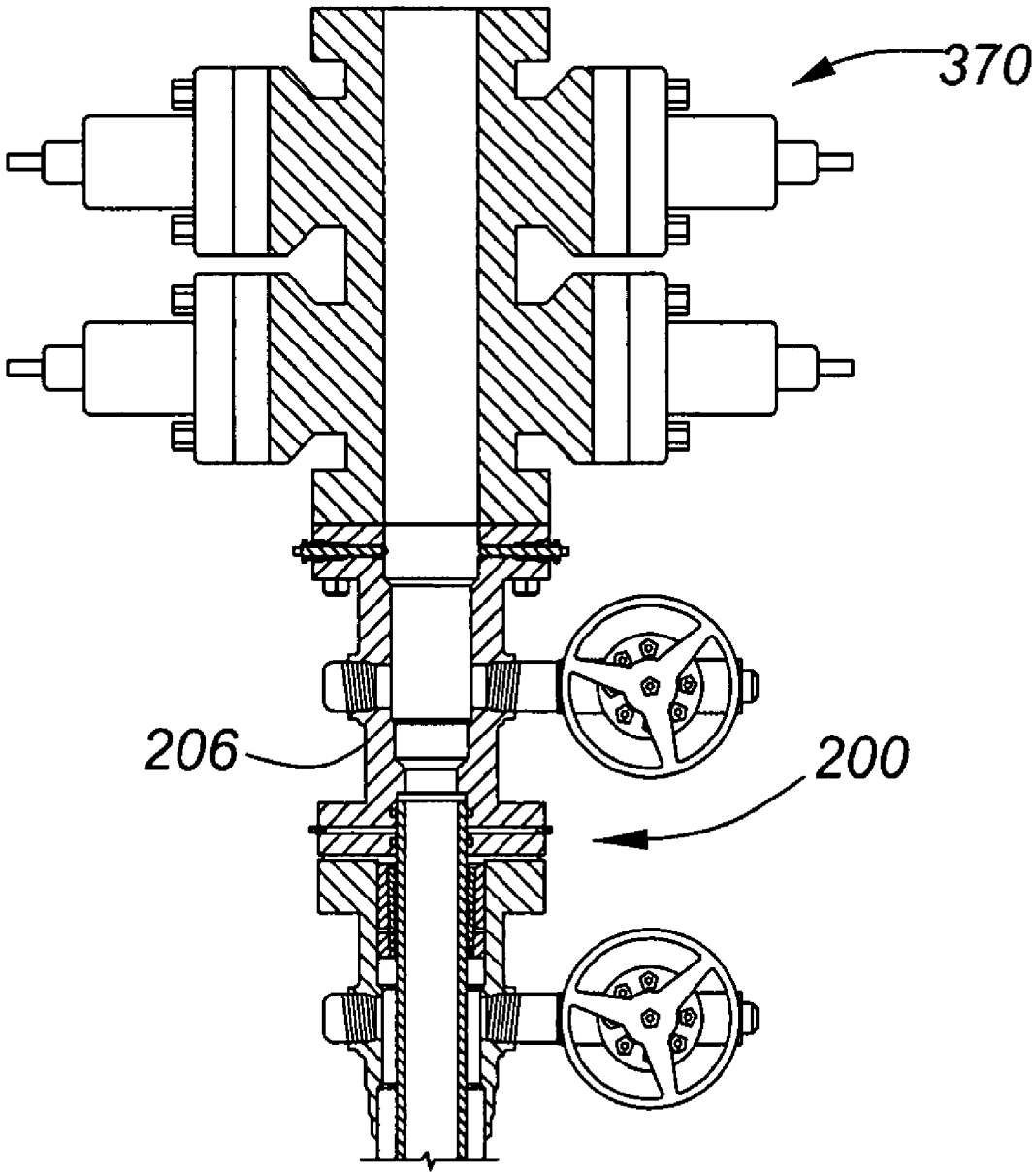
FIG. 21 is a schematic diagram of the blowout preventer with blind rams in a closed condition and the wellhead ready to be equipped for production.
Figure 8:
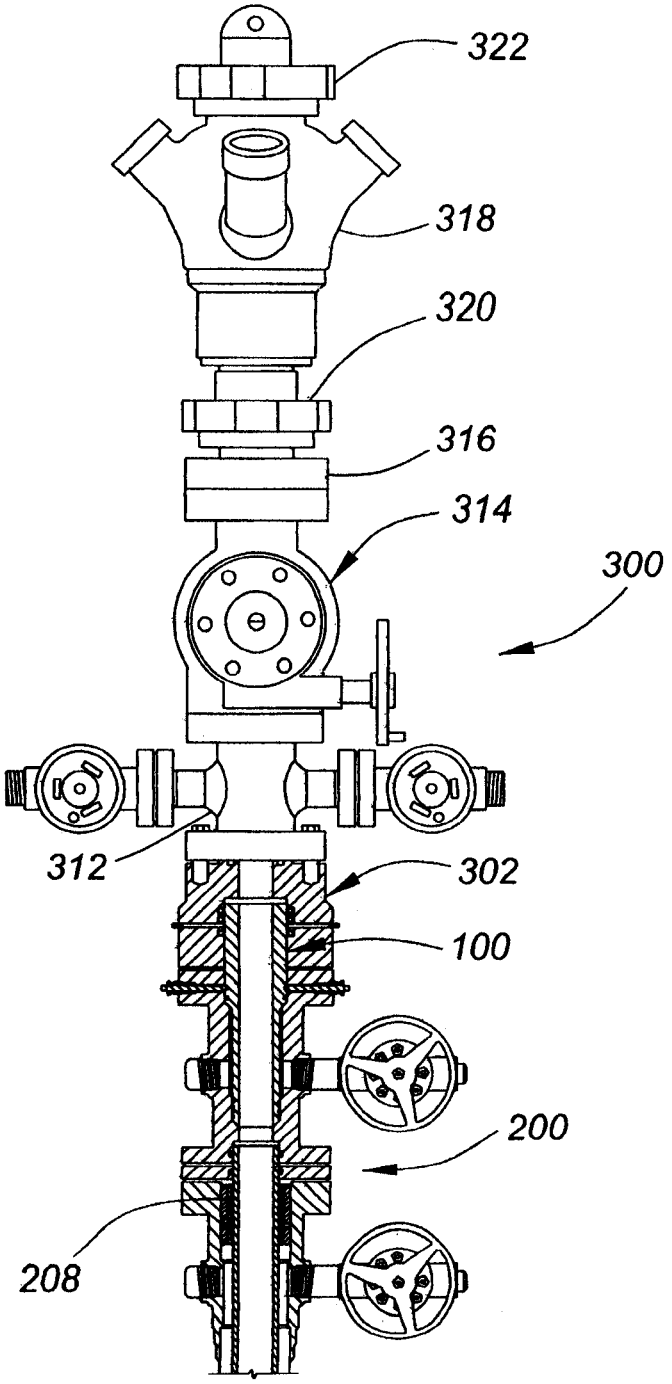
Figure 11:
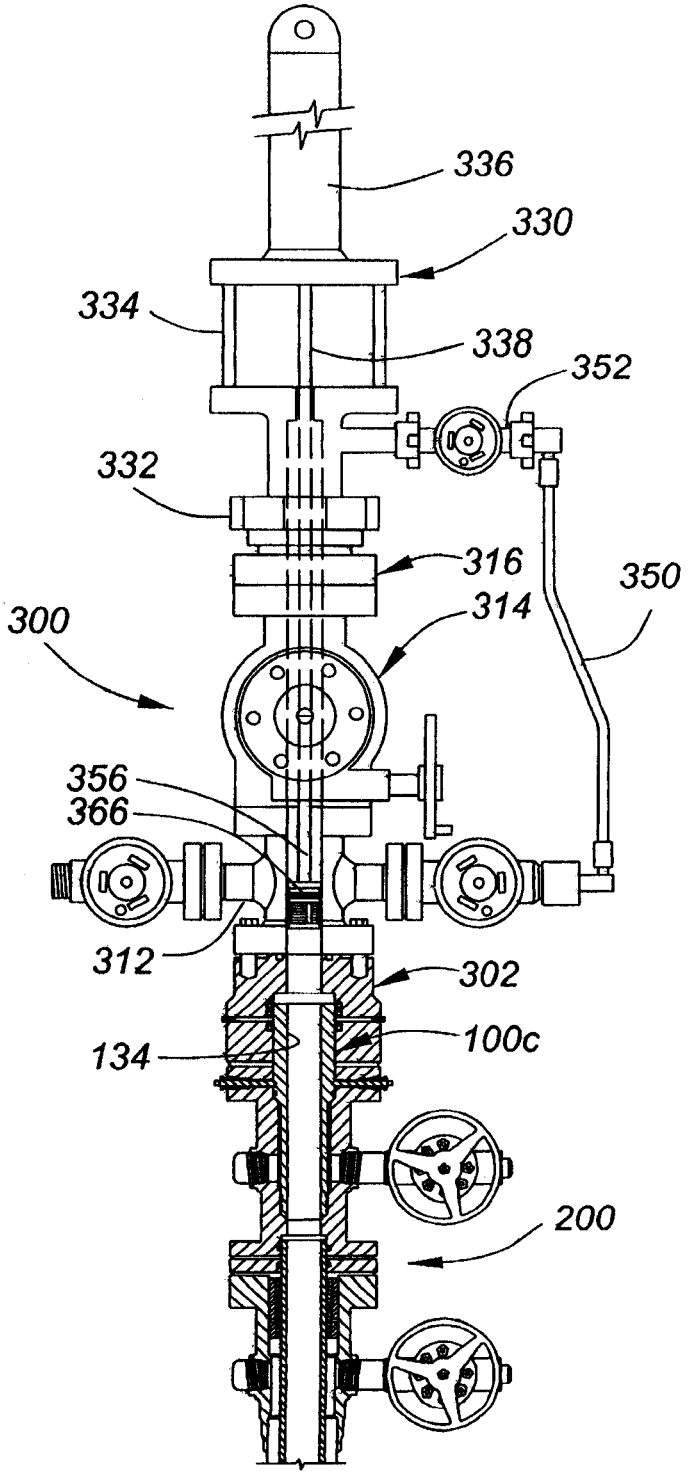

The lubricator tube 380 and the back pressure plug setting tool 330 are then removed from the blowout preventer 370 and the well is ready to be prepared for production, as shown in FIG. 21. Depending on the type of the hydrocarbon formation(s) with which the well communicates, a jointed or coil production tubing may be run into the well through the blowout preventer 370 and suspended in the well using a tubing hanger (not shown) supported by the tubing head spool 206. If so, a backpressure plug is then lubricated down through the blowout preventer 370, as described above and secured to backpressure threads in the tubing hanger. The blowout preventer 370 can then be stripped from the wellhead 200 and a production tree mounted to the wellhead 200. The backpressure plug is then lubricated out of the tubing hanger through the production tree in a manner well known in the art. Alternatively, a casing plug may be run through the blowout preventer 370 into the production casing 208 to permit the blowout preventer 370 to be removed from the wellhead 200. A production tree may be mounted to a top of the tubing head spool 206 and the casing plug lubricated out through the production tree, also in a manner well known in the art.

As will be understood by those skilled in the art, the frac mandrels 100, 100*b* or 100*c*, in combination with one of the well control adapters 302, 302*b*-302*e*, provide a versatile and inexpensive system for well completion, re-completion or workover. The frac mandrel 100, 100*b* or 100*c* and the well control adapters 302, 302*b*-302*e* can be installed and left on a wellhead for as long as required to perform a completion, re-completion or workover of the well. Operation scheduling therefore becomes less critical, delays are less costly and labor costs are reduced.

As will be further understood by those skilled in the art, the frac mandrel with the well control adapters 302, 302*b*-302*e* in accordance with the invention in combination with a well control stack enables full control of the well, while permitting equipment required for well completion, re-completion or workover to be readily and safely mounted to, or removed from, the wellhead. Since the frac mandrel 100, 100*b* and 100*c* and well control adapters 302, 302*b*-302*e* in accordance with the invention provide full-bore access to the production casing of the well, there is no restriction on the size or type of downhole tool that can be used during well completion, re-completion or workover operations.

While various alternative constructions of the frac mandrel and/or the well control adapters in accordance with the invention have been described, it should be understood that the embodiments described above are exemplary only.

The scope of the invention is therefore intended to be limited solely by the scope of the appended claims.

I claim:

1. A retrievable frac mandrel and well control adapter for facilitating completion, re-completion or workover of a cased well having a wellhead with a tubing head spool, comprising:

a frac mandrel having a central passage and a bottom end adapted to be received in the tubing head spool and to provide a high-pressure fluid seal with a seal bore of the tubing head spool;

a well control adapter that mounts to a top flange of the tubing head spool, the well control adapter comprising an axial seal bore that receives a top end of the frac mandrel and provides a high-pressure fluid seal around a smooth outer periphery of the top end of the frac mandrel, and an axial passage that has a diameter smaller than an outer diameter of the top end of the frac mandrel but at least as large as an internal diameter of the central passage of the frac mandrel; and a V-type packing received in the axial seal bore to provide the high pressure fluid seal around the top end of the frac mandrel, the V-type packing being supported on respective top and bottom ends by a respective top metal ring and a bottom metal ring, and compressed, when the well control adapter is mounted to the top flange of the tubing head spool, by a packing compression sleeve that slides over the top end of the frac mandrel and rests on the top flange of the tubing head spool.

2. The retrievable frac mandrel and well control adapter as claimed in claim 1 wherein the high-pressure fluid seal with the seal bore located above the bit guide of the tubing head spool comprises a plurality of O-ring grooves in a periphery of the bottom end of the frac mandrel, each of the O-ring grooves receiving a high-pressure O-ring that seals against the seal bore.

3. The retrievable frac mandrel and well control adapter as claimed in claim 1 wherein the frac mandrel further comprises an annular groove engaged by lockdown screws for securing a tubing hanger in the tubing head spool, the lockdown screws locking the frac mandrel in the tubing head spool.

4. The retrievable frac mandrel and well control adapter as claimed in claim 1 wherein the axial seal bore of the well control adapter further comprises two or more radial bores that receive pins which support the bottom metal ring, and the packing compression sleeve has an outer diameter small enough to bypass outer ends of the respective pins, so that when the well control adapter is lowered over the top end of the frac mandrel the packing compression sleeve forces the bottom metal ring upwardly to compress the V-type packing around the top end of the frac mandrel.

5. The retrievable frac mandrel and well control adapter as claimed in claim 1 wherein the well control adapter further comprises test ports to permit an injection of high pressure fluid to test an integrity of the high-pressure fluid seal around the periphery of the top end of the frac mandrel prior to a frac operation.

6. The retrievable frac mandrel and well control adapter as claimed in claim 1 further comprising a well control stack mounted to a top of the well control adapter, the well control stack comprising a cross-flow tee and a high pressure valve.

7. The retrievable frac mandrel and well control adapter as claimed in claim 1 wherein the central passage of the frac mandrel comprises backpressure plug threads for securing a backpressure plug to seal off the central passage.

8. The retrievable frac mandrel and well control adapter as claimed in claim 1 wherein the well control adapter further comprises test ports to permit monitoring the integrity of the high-pressure fluid seal around the periphery of the top end of the frac mandrel during a frac operation.

9. The retrievable frac mandrel and well control adapter as claimed in claim 1 wherein the central passage of the frac mandrel comprises an annular groove engaged by a hydraulic shear-off tubing plug to seal off the central passage.

10. The retrievable frac mandrel and well control adapter as claimed in claim 1 wherein the central passage of the frac mandrel comprises a smooth bore that is gripped by a through-tubing plug to seal off the central passage.

* * * * *

UNITED STATES PATENT AND TRADEMARK OFFICE

CERTIFICATE OF CORRECTION

PATENT NO. : 7,806,175 B2
APPLICATION NO. : 11/803030
DATED : October 5, 2010
INVENTOR(S) : Barton E. Hickie It is certified that error appears in the above-identified patent and that said Letters Patent is hereby corrected as shown below:

Delete Drawing Sheet 12 of 25 and Drawing Sheet 15 of 25 and substitute therefore the attached replacement Drawing Sheet 12 of 25 and Drawing Sheet 15 of 25.

Signed and Sealed this
Thirty-first Day of July, 2012

David J. Kappos

David J. Kappos
*Director of the United States Patent and Trademark Office*